US011162396B2

(12) United States Patent
Sakaguchi et al.

(10) Patent No.: US 11,162,396 B2
(45) Date of Patent: Nov. 2, 2021

(54) VALVE OPENING-CLOSING TIMING CONTROL DEVICE

(71) Applicant: AISIN SEIKI KABUSHIKI KAISHA, Kariya (JP)

(72) Inventors: Kenta Sakaguchi, Kariya (JP); Takeo Asahi, Kariya (JP); Kazuo Ueda, Gamagori (JP); Tomohiro Kajita, Anjo (JP); Yusei Shinpo, Toyota (JP)

(73) Assignee: AISIN CORPORATION, Kariya (JP)

( * ) Notice: Subject to any disclaimer, the term of this patent is extended or adjusted under 35 U.S.C. 154(b) by 120 days.

(21) Appl. No.: 16/426,480

(22) Filed: May 30, 2019

(65) Prior Publication Data

US 2020/0011214 A1 Jan. 9, 2020

(30) Foreign Application Priority Data

Jul. 5, 2018 (JP) ..... JP2018-128504

(51) Int. Cl.
*F01L 1/344* (2006.01)

(52) U.S. Cl.
CPC ... *F01L 1/3442* (2013.01); *F01L 2001/34426* (2013.01)

(58) Field of Classification Search
CPC ..... F01L 1/3442; F01L 1/344; F01L 2001/34426; F01L 2001/3443; F01L 2001/34433; F01L 1/02; F01L 1/047; F01L 1/46; F01L 2001/3445; F01L 2001/34469; F01L 2001/34483; F01L 2001/3444; F01L 2001/0476; F01L 2820/032; F02D 2041/001
USPC ..... 123/90.15, 90.16, 90.17
See application file for complete search history.

(56) References Cited

U.S. PATENT DOCUMENTS

| | | | | |
|---|---|---|---|---|
| 5,971,015 | A * | 10/1999 | Gonsior | F16K 15/04 137/533.11 |
| 7,389,756 | B2 | 6/2008 | Hoppe et al. | |
| 10,273,834 | B2 * | 4/2019 | Kajita | F01L 1/047 |
| 10,273,835 | B2 * | 4/2019 | Kajita | F01L 1/3442 |
| 10,273,836 | B2 * | 4/2019 | Asahi | F01L 1/047 |
| 2013/0118622 | A1 | 5/2013 | Patzold et al. | |

(Continued)

FOREIGN PATENT DOCUMENTS

| | | | |
|---|---|---|---|
| JP | 2009515090 | A | 4/2009 |
| JP | 2018138779 | A | 9/2018 |

*Primary Examiner* — Devon C Kramer
*Assistant Examiner* — Kelsey L Stanek
(74) *Attorney, Agent, or Firm* — Buchanan Ingersoll & Rooney PC

(57) ABSTRACT

A valve opening-closing timing control device includes a valve case in which an inner space is formed in a direction along a rotational axis, and a valve unit accommodated in the inner space so as to be coaxial with the rotation axis and controlling fluid to and from an advance chamber and a retard chamber. The valve unit includes a check valve on an upstream side to which fluid is supplied. The check valve includes a valve seat in which a flow passage hole through which the fluid flows is formed, and a valve body including a closing portion that can close the flow passage hole. The valve seat includes a first projection portion to surround the flow passage hole. The check valve is closed by the closing portion contacting against the first projection portion, and is opened by the closing portion being separated from the first projection portion.

8 Claims, 12 Drawing Sheets

(56) References Cited

U.S. PATENT DOCUMENTS

| | | | | |
|---|---|---|---|---|
| 2015/0300212 | A1* | 10/2015 | Bayrakdar | F01L 1/3442<br>123/90.15 |
| 2017/0058727 | A1* | 3/2017 | Smith | F01L 1/047 |
| 2018/0058272 | A1* | 3/2018 | Haltiner, Jr. | F01L 1/3442 |
| 2018/0135473 | A1* | 5/2018 | Asahi | F01L 1/3442 |
| 2018/0245488 | A1* | 8/2018 | Hamasaki | F15B 13/0402 |

* cited by examiner

VALVE OPENING-CLOSING TIMING CONTROL DEVICE

CROSS REFERENCE TO RELATED APPLICATIONS

This application is based on and claims priority under 35 U.S.C. § 119 to Japanese Patent Application 2018-128504, filed on Jul. 5, 2018, the entire content of which is incorporated herein by reference

TECHNICAL FIELD

This disclosure generally relates to a valve opening-closing timing control device.

BACKGROUND

In recent years, a valve opening-closing timing control device that can change opening and closing timings of an intake valve and an exhaust valve, depending on an operating condition of an internal combustion engine (hereinafter, also referred to as "engine") has been put into practice. For example, this valve opening-closing timing control device includes a mechanism that changes a relative rotational phase of a driven-side rotational body (hereinafter, also simply referred to as "relative rotational phase") to rotation of a drive-side rotational body caused by an operation of the engine, and thereby changes opening and closing timings of the intake and exhaust valves being opened and closed according to rotation of the driven-side rotational body.

Japanese Translation of PCT International Application No. 2009-515090 (Reference 1) discloses, as a device (a valve opening-closing timing control device) variably adjusting a gas exchange valve, a technique in which a control valve is provided inside a central screw connected to a camshaft, and a check valve is provided in a path for supplying a pressure medium (fluid) to the control valve.

In this Reference 1, the check valve is configured to include a closing body (ball) pressed in a closing direction by a spring element.

Specification of U.S. Patent Application Publication No. 2013/0118622 (Reference 2) describes a technique in which a control piston is accommodated in a housing, and in a path for supplying hydraulic oil to this control piston, a check valve preventing a backflow of hydraulic oil is provided.

In this Reference 2, the check valve is configured to include a plate-shaped valve seat with an opening being formed therein, and a valve body supported by a plate-shaped elastic material so as to be able to close the opening.

Further, Specification of U.S. Patent Application Publication No. 2015/0300212 (Reference 3) describes a technique in which a check valve having a configuration similar to that of Reference 2 and a relief valve are provided in parallel.

When, in an inner space of a connection bolt that connects a valve opening-closing timing control device to a camshaft, a valve unit is arranged near a rotational axis of the valve opening-closing timing control device, a distance between the valve unit and an advance chamber or a retard chamber formed between a drive-side rotational body and a driven-side rotational body can be shortened, and thus, pressure loss in a flow channel can be reduced, thereby enabling an operation of good response to be implemented.

In the configuration in which the valve unit is arranged near the rotational axis in this manner, it is reasonable that the valve unit includes a check valve as also described in References 1 to 3.

However, when a ball is used as a check valve as described in Reference 1, a space for accommodating the ball is required, and a size of a valve opening-closing timing control device tends to become larger because of necessity of securing a space for operating the ball to an open position. Further, in the check valve of this configuration, the ball is arranged at a central position of the flow channel, and for this reason, pressure loss is caused by a matter that fluid contacts with the ball in a state where the check valve is open.

Meanwhile, as described in References 2 and 3, when the check valve is constituted of a plate-shaped valve seat with an opening being formed therein and a plate-shaped valve body that can close the opening, a size of the valve opening-closing timing control device can be made smaller. However, the check valves described in References 2 and 3 are each configured in such a way that the valve seat with the opening being formed therein and the valve body closing the opening are brought into contact with each other in a plane. For this reason, in some cases, at a time of supplying of fluid, surface tension and the like is generated on surfaces on which the valve seat and the valve body contact with each other, leading to a state where it is difficult that the valve body separates from the valve seat. Further, when fluid flows backward, no pressing force is initially applied between the valve body and the valve seat with only surface contact being made, and for this reason, there is a possibility that sealing performance of the valve body to the opening of the valve seat becomes insufficient.

A need thus exists for a valve opening-closing timing control device which is not susceptible to the drawback mentioned above.

SUMMARY

A valve opening-closing timing control device according to an aspect of this disclosure includes a drive-side rotational body, a driven-side rotational body, an advance chamber, a retard chamber, a valve case, and a valve unit. The drive-side rotational body rotates in synchronization with a crankshaft of an internal combustion engine. The driven-side rotational body is arranged coaxially with a rotational axis of the drive-side rotational body, and rotates integrally with a valve opening-closing camshaft. The advance chamber and the retard chamber are formed between the drive-side rotational body and the driven-side rotational body. In the valve case, an inner space is formed in a direction along the rotational axis so as to range from an outside to the camshaft. The valve unit is accommodated in the inner space so as to be coaxial with the rotation axis, and controls supply and discharge of fluid to and from the advance chamber and the retard chamber. The valve unit includes a check valve on an upstream side to which the fluid is supplied. The check valve includes a valve seat and a valve body. In the valve seat, a flow passage hole through which the fluid flows is formed. The valve body includes a closing portion that can close the flow passage hole. The valve seat includes a first projection portion that is on a side of facing the valve body and that is at a position surrounding the flow passage hole. The check valve is closed by the closing portion contacting against the first projection portion, and is opened by the closing portion being separated from the first projection portion.

In the check valve of the present configuration, the closing portion of the valve body contacts against the first projection portion formed on the valve seat, thereby closing the valve. Thus, the check valve in a valve-closed state is in a state where the valve body contacts against only the first projection portion of the valve seat, and for this reason, an area of an interface where the valve seat and the valve body contact with each other is small. Accordingly, when fluid is applied in a direction in which the valve body separates from the valve seat, the valve body easily separates from the first projection portion of the valve seat, and pressure loss in a fluid supply path can be prevented from occurring.

Therefore, it is possible to configure the valve opening-closing timing control device capable of effectively preventing a backflow of fluid while smoothly supplying fluid to the valve unit via the check valve.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, embodiments of this disclosure are described on the basis of the drawings.

[First Embodiment]

Hereinafter, a first embodiment of a valve opening-closing timing control device according to this disclosure is described with reference to FIGS. 1 to 9.

[Basic Configuration]

Figure 1:
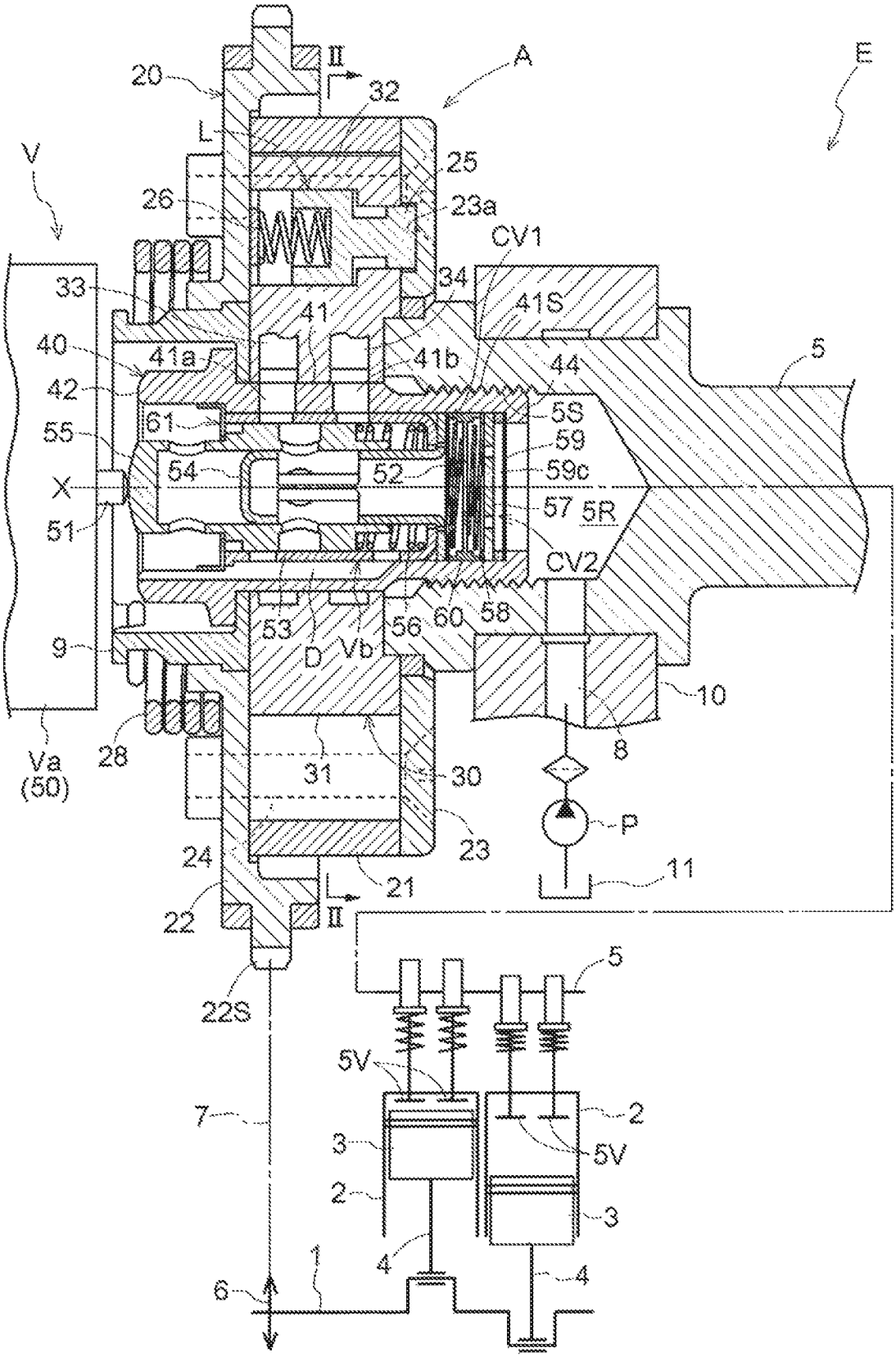
FIG. 1 is a cross-sectional view illustrating an entire configuration of a valve opening-closing timing control device.
Figure 2:
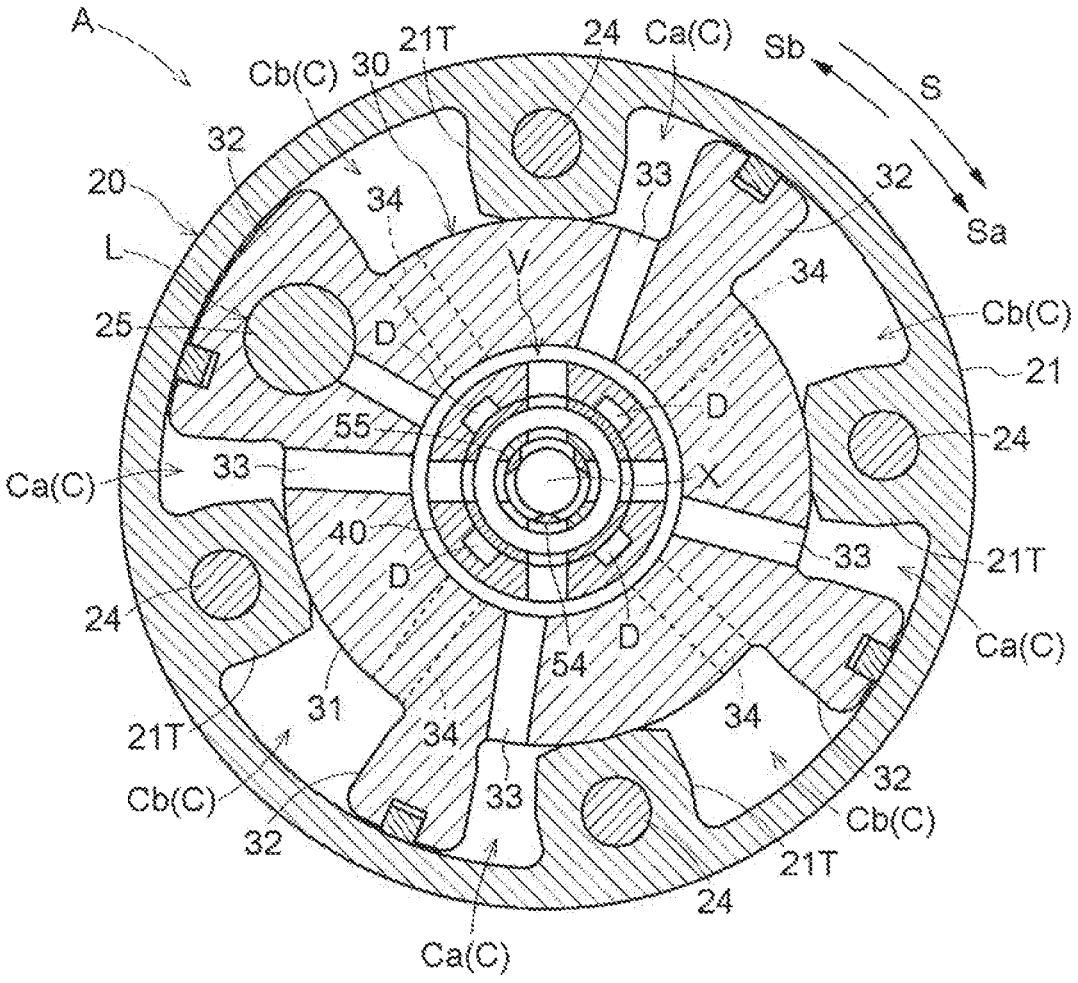
FIG. 2 is a cross-sectional view taken along a line II-II in FIG. 1.
Figure 3:
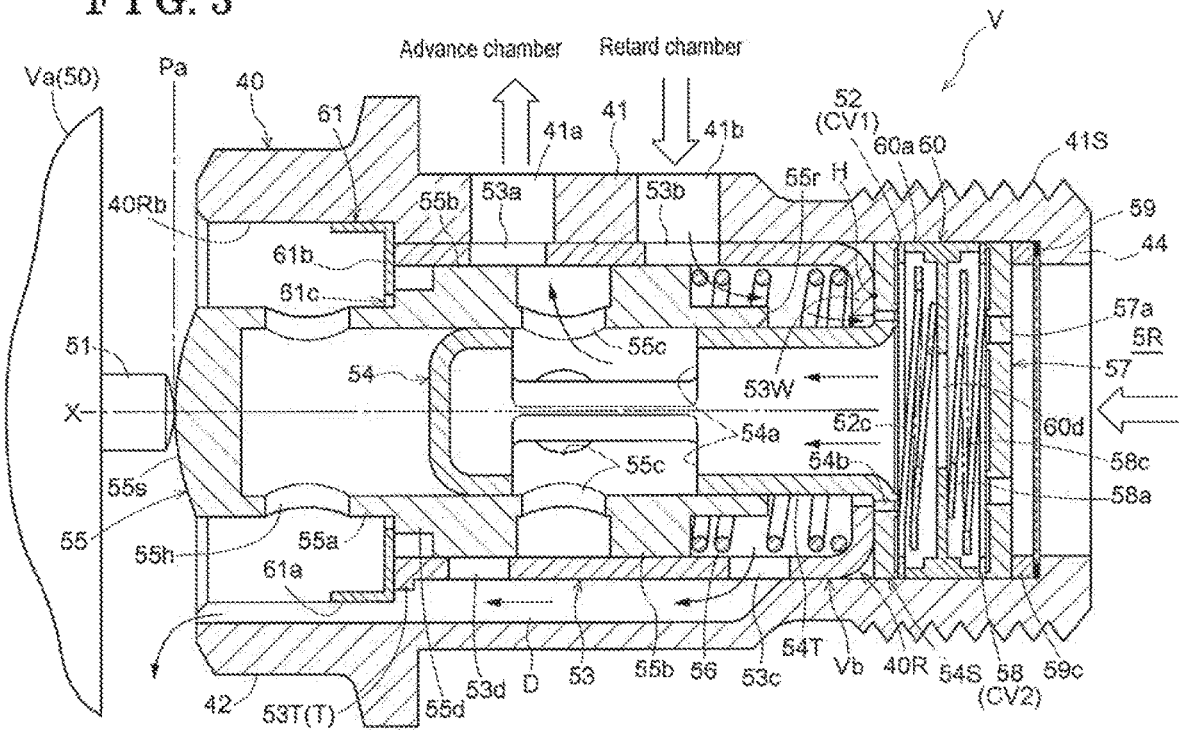
FIG. 3 is a cross-sectional view of a valve unit with a spool being at an advance position.

As illustrated in FIGS. 1 to 3, a valve opening-closing timing control device A is configured to include an outer rotor 20 as a drive-side rotational body, an inner rotor 30 as a driven-side rotational body, and an electromagnetic control valve V that controls hydraulic oil as hydraulic fluid.

The inner rotor 30 (one example of a driven-side rotational body) is arranged coaxially with a rotational axis X of a valve opening-closing intake camshaft 5, and is connected to the intake camshaft 5 by a connection bolt 40 (one example of a valve case) so as to rotate integrally with the intake camshaft 5. The outer rotor 20 (one example of a drive-side rotational body) is arranged coaxially with the rotational axis X, and rotates in synchronization with a crankshaft 1 of an engine E as an internal combustion engine. The outer rotor 20 contains the inner rotor 30, and the inner rotor 30 is supported by the outer rotor 20 so as to be freely rotatable relative to the outer rotor 20.

The electromagnetic control valve V includes an electromagnetic unit Va supported by the engine E, and a valve unit Vb accommodated in an inner space 40R of the connection bolt 40.

The electromagnetic unit Va includes a solenoid unit 50 and a plunger 51. The plunger 51 is arranged coaxially with the rotational axis X so as to move outward and inward by drive control of the solenoid unit 50. The valve unit Vb includes a spool 55 that controls supplying and discharging of hydraulic oil (one example of fluid) and that is arranged coaxially with the rotational axis X.

With this configuration, a projection amount of the plunger 51 is set by control of electric power supplied to the solenoid unit 50, and in conjunction with this, the spool 55 is operated in a direction along the rotational axis X. As a result, hydraulic oil is controlled by the spool 55, a relative rotational phase between the outer rotor 20 and the inner rotor 30 is determined, and control of opening and closing timings of intake valves 5V is implemented. A configuration of the electromagnetic control valve V and a control mode of the hydraulic oil are described later.

FIG. 1 illustrates the engine E (one example of an internal combustion engine) provided in a vehicle such as a passenger car. The engine E is configured as a four-cycle type in which pistons 3 are accommodated inside cylinder bores of cylinder blocks 2 at upper positions, and the pistons 3 and the crankshaft 1 are connected by connecting rods 4. At an upper portion of the engine E, the intake camshaft 5 that opens and closes the intake valves 5V and an un-illustrated exhaust camshaft are provided.

In an engine-constituting member 10 that freely rotatably supports the intake camshaft 5, there is formed a supply flow channel 8 for supplying hydraulic oil from an oil pressure pump P driven by the engine E. By the oil pressure pump P, lubricating oil stored in an oil pan 11 of the engine E is supplied as hydraulic oil to the electromagnetic control valve V via the supply flow channel 8.

A timing chain 7 is wound around an output sprocket 6 formed on the crankshaft 1 of the engine E and a timing sprocket 22S of the outer rotor 20. Thereby, the outer rotor 20 rotates in synchronization with the crankshaft 1. Note that a sprocket is also provided at a front end of the exhaust camshaft on an exhaust side, and a timing chain 7 is also wound around this sprocket.

As illustrated in FIG. 2, the outer rotor 20 rotates in a drive rotation direction S by driving force from the crankshaft 1. A direction in which the inner rotor 30 rotates in the same direction as the drive rotation direction S relative to the outer rotor 20 is referred to as an advance direction Sa, and a direction opposite to this direction is referred to as a retard direction Sb. In this valve opening-closing timing control device A, a relation between the crankshaft 1 and the intake camshaft 5 is set in such a way that, when a relative rotational phase is displaced in the advance direction Sa, an intake compression ratio is more increased as a displaced amount thereof increases, and, when a relative rotational phase is displaced in the retard direction Sb, an intake compression ratio is more decreased as a displaced amount thereof increases.

Note that, in this embodiment, the valve opening-closing timing control device A provided at the intake camshaft 5 is described, but the valve opening-closing timing control device A may be provided at the exhaust camshaft. Further, the valve opening-closing timing control device A may be provided at each of the intake camshaft 5 and the exhaust camshaft.

As illustrated in FIGS. 1 and 2, the outer rotor 20 includes an outer rotor body 21, a front plate 22, and a rear plate 23, which are integrated with one another by fastening of a plurality of fastening bolts 24. A timing sprocket 22S is formed on an outer circumference of the front plate 22. Further, an annular member 9 is fitted into an inner circumference of the front plate 22, and a bolt head 42 of the connection bolt 40 is pressed to and contacted with the annular member 9, whereby the annular member 9, the inner rotor body 31, and the intake camshaft 5 are integrated with one another.

As illustrated in FIG. 2, in the outer rotor body 21, a plurality of protrusion portions 21T projecting inward in a radial direction are integrally formed. The inner rotor 30 includes a cylindrical inner rotor body 31 in close contact with the protrusion portions 21T of the outer rotor body 21, and four vane portions 32 projecting outward in the radial direction from an outer circumference of the inner rotor body 31 so as to contact with an inner circumferential surface of the outer rotor body 21.

As described above, the outer rotor 20 contains the inner rotor 30, and on an outer circumferential side of the inner rotor body 31, a plurality of fluid pressure chambers C are formed each at an intermediate position between the protrusion portions 21T adjacent to each other in the rotational direction. The fluid pressure chamber C is divided by the vane portion 32, thereby defining an advance chamber Ca and a retard chamber Cb. Further, in the inner rotor 30, there are formed an advance channel 33 communicating with the advance chamber Ca and a retard channel 34 communicating with the retard chamber Cb.

As illustrated in FIGS. 1 and 2, a torsion spring 28 is provided so as to range over the outer rotor 20 and the annular member 9. The torsion spring 28 causes pressing force to be applied in an advance direction Sa, thereby assisting displacement of a relative rotational phase between the outer rotor 20 and the inner rotor 30 (hereinafter, referred to as relative rotational phase) in the advance direction Sa from the most retarded phase.

As illustrated in FIGS. 1 and 2, the valve opening-closing timing control device A includes a lock mechanism L that holds, at the most retarded phase, a relative rotational phase between the outer rotor 20 and the inner rotor 30. The lock mechanism L is constituted of a lock member 25 supported so as to be able to freely move outward and inward in a direction along the rotational axis X relative to one vane portion 32, a lock spring 26 that presses the lock member 25 so as to protrude, and a lock recess portion 23*a* formed in the rear plate 23. Note that the lock mechanism L may be configured so as to guide the lock member 25 to be moved along the radial direction.

When a relative rotational phase reaches the most retarded phase, the lock member 25 engages with the lock recess portion 23*a* by pressing force of the lock spring 26, and thereby, the lock mechanism L leads to be in a lock state. Meanwhile, the lock of the lock mechanism L is released by applying, to the lock member 25 in a lock release direction, pressure of hydraulic oil applied to the advance channel 33.

[Connection Bolt]

Figure 4:
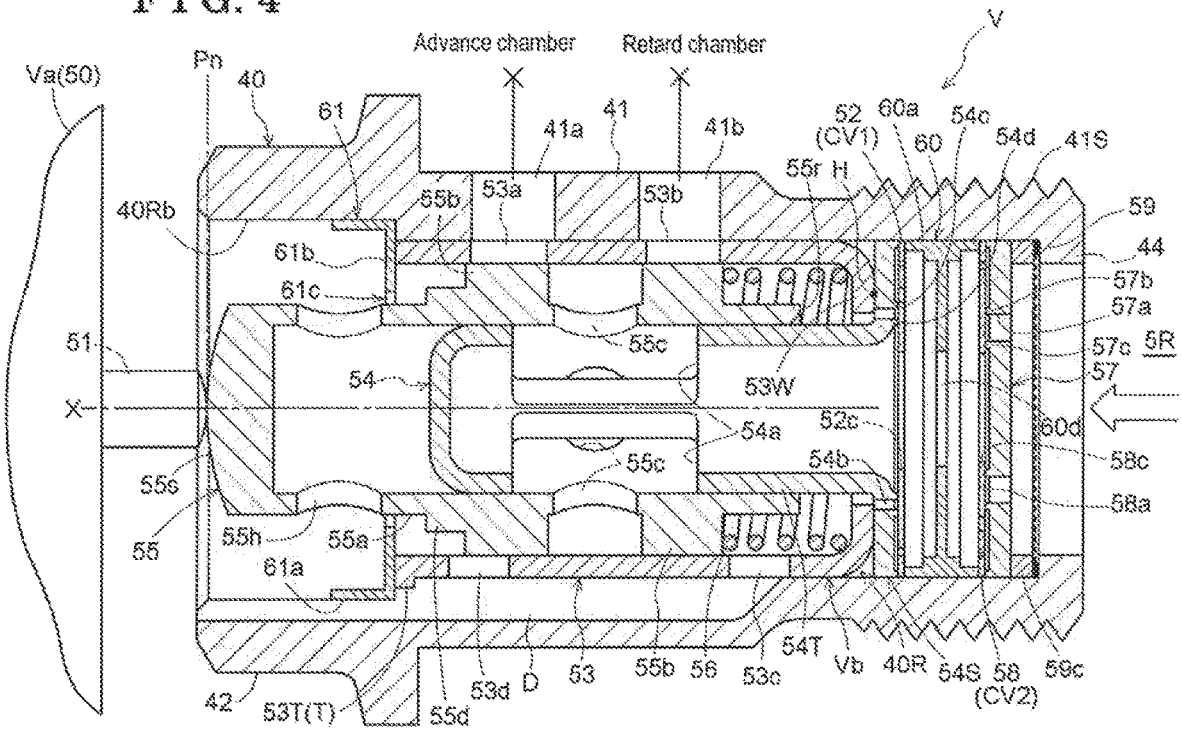
FIG. 4 is a cross-sectional view of the valve unit with the spool being at a neutral position.
Figure 5:
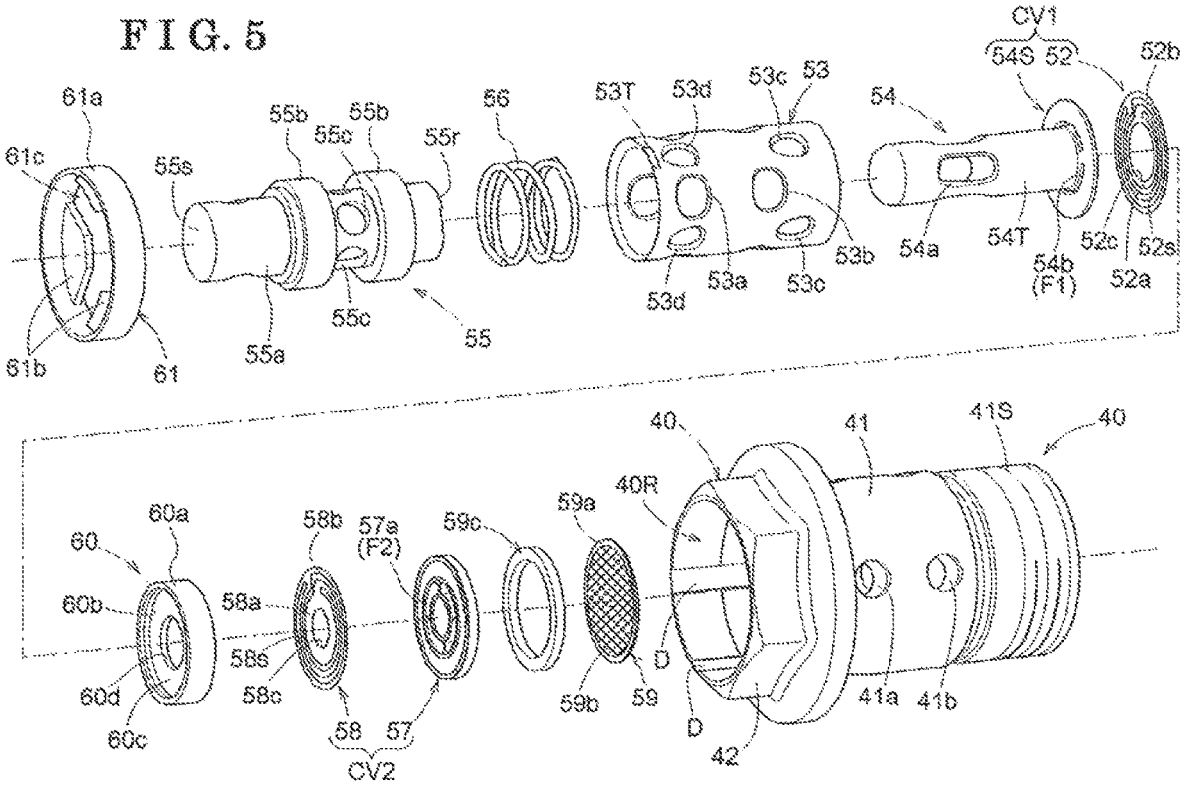
FIG. 5 is an exploded perspective view of the valve unit.

As illustrated in FIGS. 3 to 5, in the connection bolt 40, there is formed a bolt head portion 42 at an outer end portion (on a side of facing the electromagnetic unit Va) of a bolt body 41 that is entirely cylindrical. Further, a male screw portion 41S is formed on an outer circumference of the bolt body 41 on a side opposite to the bolt head portion 42.

Inside the connection bolt 40, there is formed a cylindrical inner space 40R penetrating in a direction along the rotation axis X. Thereby, the connection bolt 40 as a valve case can accommodate the valve unit Vb in the inner space 40R.

In the following, when a direction and a relative positional relation of each portion of the valve opening-closing timing control device A are described, a side of the male screw portion 41S of the bolt body 41 in a direction along the rotational axis X, i.e., a side of the intake camshaft 5 is referred to as a screw portion side in some cases. In addition, a side of the bolt head portion 42 of the bolt body 41 in the direction along the rotational axis X, i.e., a side that faces the electromagnetic unit Va and that is an end side opposite, via the connection bolt 40, to the side of the intake camshaft 5 is referred to as a head portion side in some cases. Note that the screw portion side and the head portion side respectively correspond to an upstream side and a downstream side of a flow pass direction of hydraulic oil supplied via the supply flow channel 8.

As illustrated in FIG. 1, in the intake camshaft 5, an in-shaft space 5R whose center is the rotational axis X is formed, and on an inner circumference of the in-shaft space 5R, a female screw portion 5S is formed. The in-shaft space 5R communicates with the above-described supply flow channel 8.

With this configuration, in a state where the bolt body 41 is inserted through the annular member 9, the outer rotor 20, and the inner rotor 30, the male screw portion 41S is screwed into the female screw portion 5S of the intake camshaft 5, and the inner rotor 30 is fastened to the intake camshaft 5 by a rotational operation of the bolt head portion 42. By this fastening, the annular member 9 and the inner rotor 30 are fixed to the intake camshaft 5, and the in-shaft space 5R and the inner space 40R of the connection bolt 40 communicate with each other.

As illustrated in FIGS. 4 and 5, a large-diameter portion 40Rb is formed at a portion that is included in an inner circumferential surface of the inner space 40R of the connection bolt 40 and that is on the head portion side.

At an end portion that is included in the inner circumferential surface of the inner space 40R of the connection bolt 40 and that is on the screw portion side in a direction along the rotational axis X, there is formed a restriction wall 44 protruding in a direction of approaching the rotational axis X (protruding toward an inner side of the inner space 40R). The restriction wall 44 is provided as an annular wall on the inner circumferential surface.

A plurality of (four) drain grooves D are formed in a posture of being along the rotational axis X, on the inner circumference of the connection bolt 40, in a region ranging from an intermediate position and reaching a distal end (the connection bolt 40) of the large-diameter portion 40Rb.

An advance port 41*a* communicating with the advance fluid channel 33, and a retard port 41*b* communicating with the retard fluid channel 34 are formed so as to range from the outer circumferential surface to the inner space 40R in the bolt body 41.

[Valve Unit]

As illustrated in FIGS. 3 to 5, in the inner space 40R of the connection bolt 40, the valve unit Vb includes a sleeve 53 fitted in close contact with the inner circumferential surface of the bolt body 41, a fluid supply pipe 54 being coaxial with the rotational axis X and accommodated in the inner space 40R, and a spool 55 arranged so as to be freely slidable in a direction along the rotational axis X in a state of being guided by an inner circumferential surface of the sleeve 53 and an outer circumferential surface of a pipe channel portion 54T of the fluid supply pipe 54.

Further, the valve unit Vb includes a spool spring 56 as a pressing member that presses the spool 55 in a protrusion direction, a first check valve CV1, a second check valve CV2, a filter 59, a fixing ring 60, and a distal end ring 61.

The first check valve CV1 is constituted of a proximal end portion 54S of the fluid supply pipe 54, and a first valve plate 52. The second check valve CV2 is constituted of an opening plate 57 and a second valve plate 58.

The fixing ring 60 includes an outer cylindrical portion 60*a* fitted into the inner space 40R, an inner cylindrical portion 60*b* having an inner diameter smaller than the outer cylindrical portion 60*a* of a cylindrical shape, and a wall portion 60*c* that is at an approximately intermediate position in the fixing ring 60 in a direction along the rotational axis X and that perpendicularly intersects with the rotational axis X. In the wall portion 60*c*, a circular opening portion 60*d* whose center is the rotational axis X is formed.

The distal end ring 61 includes an outer cylindrical portion 61*a* fitted into the inner space 40R, and a wall portion 61*b* that is on the screw portion side in the outer cylindrical portion 61*a* and that perpendicularly intersects with the rotation axis X. In the wall portion 61*b*, an opening portion 61*c* whose center is the rotational axis X is formed.

[Valve Unit: Sleeve]

As illustrated in FIGS. 3 to 5, the sleeve 53 is a cylindrical member whose center is the rotational axis X. The sleeve 53 includes, on the head portion side, a plurality of (two) engagement projections 53T that protrude from an outer circumference of the cylinder of the sleeve 53 in a direction intersecting with the direction along the rotational axis X. Further, in the sleeve 53, by reducing or the like, a screw portion side thereof is bent into a posture perpendicular to the rotational axis X, thereby forming an end portion wall 53W.

The engagement projections 53T are fitted into the drain grooves D whereby a posture of the sleeve 53 whose center is the rotational axis X is fixed, and a state where drain holes 53*c* and drain holes 53*d* to be described later communicate with the drain grooves D is maintained.

In the sleeve 53, a plurality of advance communication holes 53*a* that cause the advance port 41*a* to communicate with the inner space 40R, a plurality of retard communication holes 53*b* that cause the inner space 40R to communicate with the retard port 41*b*, and a plurality of the drain holes 53*c* that discharge hydraulic oil in the inner space 40R to an outer surface side of the sleeve 53 are formed in square-hole shapes (rectangular shapes). The drain holes 53*c* are formed on the screw portion side in the sleeve 53. In the sleeve 53, the drain holes 53*d* are also formed on the head portion side.

The advance communication holes 53*a* and the retard communication holes 53*b* are arranged, in a distributed manner, at four locations in the circumferential direction whose center is the rotation axis X, and are formed in parallel with respect to the direction along the rotation axis X.

The drain holes 53*c* and the drain holes 53*d* are arranged, in a distributed manner, at four locations in the circumferential direction whose center is the rotational axis X, and are formed so as to have phases different from those of the advance communication holes 53*a* and the retard communication holes 53*b*.

Each of the drain holes 53*c* and each of the drain holes 53*d* in the circumferential direction are provided as a pair at the same phase. In other words, a pair of the drain hole 53*c* and the drain hole 53*d* are arranged so as to be aligned to each other in the direction along the rotation axis X.

The above-described engagement projections 53T are arranged on extension lines in the direction along the rotation axis X, based on two drain holes 53*c*, among the four drain holes 53*c*, facing each other and sandwiching the rotational axis X.

The sleeve 53 is fitted into the inner space 40R of the connection bolt 40 in a state where the engagement projections 53T are along the drain grooves D. Thereby, the drain groove D of the connection bolt 40 as a valve case is arranged between the connection bolt 40 and the sleeve 53, and a space communication passage surrounded by a groove inner circumferential surface of the drain groove D and the outer circumferential surface of the sleeve 53 can be formed between the connection bolt 40 and the sleeve 53. Since the drain groove D is formed so as to range over a region reaching an end surface of the bolt head portion 42 of the connection bolt 40, the space communication passage is formed so as to communicate with an outside of the connection bolt 40.

Further, the advance communication hole 53*a* and the advance port 41*a* communicate with each other. The retard communication hole 53*b* and the retard port 41*b* communicate with each other. A state where the drain holes 53*c* and the drain holes 53*d* communicate with the drain grooves D is maintained.

Thereby, in the valve unit Vb, a space between the sleeve 53 and the spool 55 (a space closer to the intake camshaft 5 than a pair of land portions 55*b*), and a space between the spool 55 (an outer circumference of a spool body 55*a*) and a side of the intake camshaft 5 in the wall portion 61*b* (a space closer to a side of facing the electromagnetic unit Va than a pair of the land portions 55*b*) communicate with the drain groove D as the space communication passage formed between the connection bolt 40 and the sleeve 53.

[Valve Unit: Fluid Supply Pipe]

As illustrated in FIGS. 3 to 5, in the fluid supply pipe 54, there are integrally formed a proximal end portion 54S fitted into the inner space 40R, and a pipe portion 54T that has a diameter smaller than that of the proximal end portion 54S and that extends from the proximal end portion 54S toward the head portion side in the inner space 40R, with supply openings 54*a* being formed on an outer circumference of a distal end portion of the pipe portion 54T.

The proximal end portion 54S is configured so as to have a shape of a circle whose center is the rotational axis X, with a diameter of being fitted into the inner space 40R, to be provided in a posture perpendicular to the rotational axis X, and to be provided with a circulation hole 54*b* formed near a boundary with the pipe portion 54T.

Three supply openings 54*a* formed on an outer circumference of a distal end portion of the pipe portion 54T are elongated holes extending in the direction along the rotational axis X. Further, four intermediate hole portions 55*c* formed in the spool 55 are circular. The number of the supply openings 54*a* is different from the number of the intermediate hole portions 55*c* formed in the spool 55. In the circumferential direction, an opening width of the supply opening 54*a* is larger than a width of an intermediate portion between the supply openings 54*a* adjacent to each other in the circumferential direction (a portion that is a portion of the pipe portion 54T and exists between the supply openings 54*a* and 54*a* adjacent to each other in the circumferential direction). Thereby, hydraulic oil from the pipe portion 54T can be reliably supplied to the intermediate hole portions 55*c*.

In the proximal end portion 54S, there are formed circulation holes 54*b* that are a part of the first check valve CV1. The circulation holes 54*b* are arranged as a pair of penetration holes symmetrical to each other with respect to the rotational axis X as a center so as to be in an annular region whose center is the rotational axis X and that is along the outer circumference of the pipe portion 54T. In this embodiment, the circulation holes 54*b* are two slit-shaped penetration holes formed in arc shapes.

[Valve Unit: Spool, Spool Spring]

As illustrated in FIGS. 3 to 5, the spool 55 is formed in a cylindrical shape. The spool 55 includes a spool body 55*a* including an operation end portion 55*s* formed at a distal end thereof. At an outer circumference of the spool body 55*a*, a pair of land portions 55*b* are formed in a protruding state. Further, at the outer circumference of the spool body 55*a*, there are formed a plurality of (four) intermediate hole portions 55*c* that cause an intermediate position between a pair of the land portions 55*b* to communicate with an inside of the spool 55. Between the operation end portion 55*s* and a side that is in a pair of the land portions 55*b* and that faces the electromagnetic unit Va, there is formed a drain penetration hole 55*h* that penetrates through the spool body 55*a* in a direction intersecting with (in this embodiment, perpendicular to) the rotational axis X.

At a side being included in the spool 55 and opposite to the operation end portion 55*s*, a contact end portion 55*r* is formed so as to be integrated with the land portion 55*b*. The contact end portion 55*r* contacts against the end portion wall 53W and thereby makes an operation limit when the spool 55 is operated in a plunging direction. In an end portion of a region extended from the spool body 55*a*, the contact end portion 55*r* is configured to have a diameter smaller than the land portion 55*b*.

The spool spring 56 is of a compression coil type, and is arranged between the land portion 55*b* on an inner side and the end portion wall 53W of the sleeve 53. By application of pressing force thereof, the land portion 55*b* on the head portion side in the spool 55 contacts against the wall portion 61*b*, and the spool 55 is maintained at an advance position Pa illustrated in FIG. 3. The land portion 55*b* on the head portion side includes a small-diameter portion 55*d* extending toward the wall portion 61*b* side, and the small-diameter portion 55*d* contacts against the wall portion 61*b*.

Further, in the valve unit Vb, a positional relation is set in such a way that the end portion wall 53W of the sleeve 53 and the proximal end portion 54S of the fluid supply pipe 54 contact against each other in the direction along the rotational axis X. Planar accuracy of the end portion wall 53W and the proximal end portion 54S contacting against each other in this manner is set to be high, and thereby, the end portion wall 53W and the proximal end portion 54S are configured as a seal portion H that blocks a flow of hydraulic oil.

Note that the end portion wall 53W is provided apart from the outer circumferential surface of the pipe portion 54T, and a gap is formed between both thereof. Hydraulic oil discharged from the advance chamber Ca or the retard chamber Cb to a space between the sleeve 53 and the spool 55 can flow (circulate) to the fluid supply pipe 54 via the gap and the circulation holes 54*b*.

In this configuration, a position of the proximal end portion 54S of the fluid supply pipe 54 is fixed by the fixing ring 60. For this reason, the proximal end portion 54S functions as a retainer.

Further, since pressing force of the spool spring 56 is applied to the end portion wall 53W of the sleeve 53, the end portion wall 53W is pressed so as to contact against the proximal end portion 54S.

Accordingly, by setting mutual postures of the end portion wall 53W and the proximal end portion 54S so as to closely contact with each other, the end portion wall 53W is made to closely contact with the proximal end portion 54S by utilizing pressing force of the spool spring 56 whereby this portion constitutes the seal portion H.

[First Check Valve]

Figure 6:
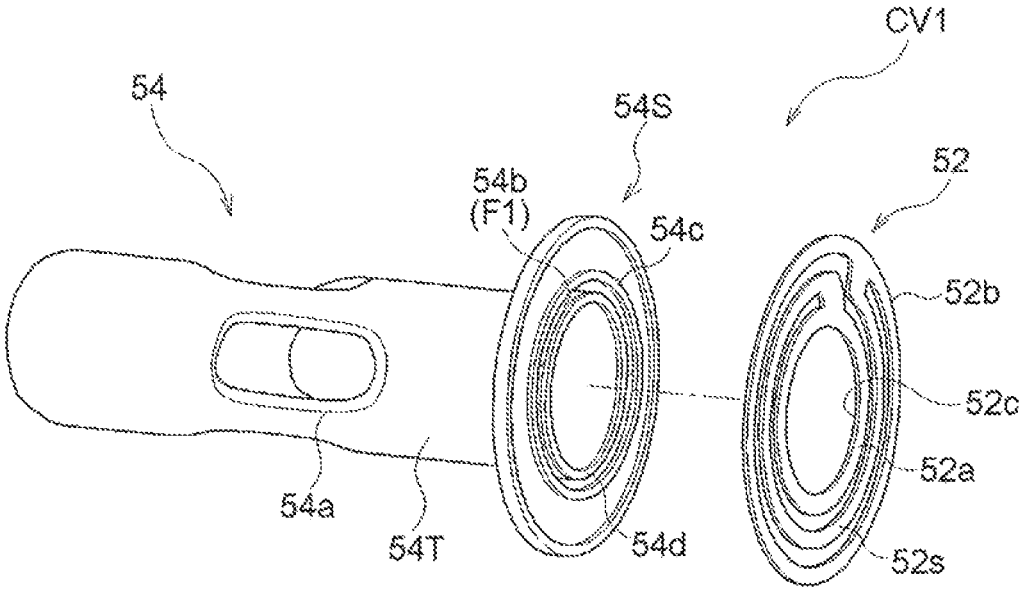
FIG. 6 is an exploded perspective view of a first check valve.
Figure 7:
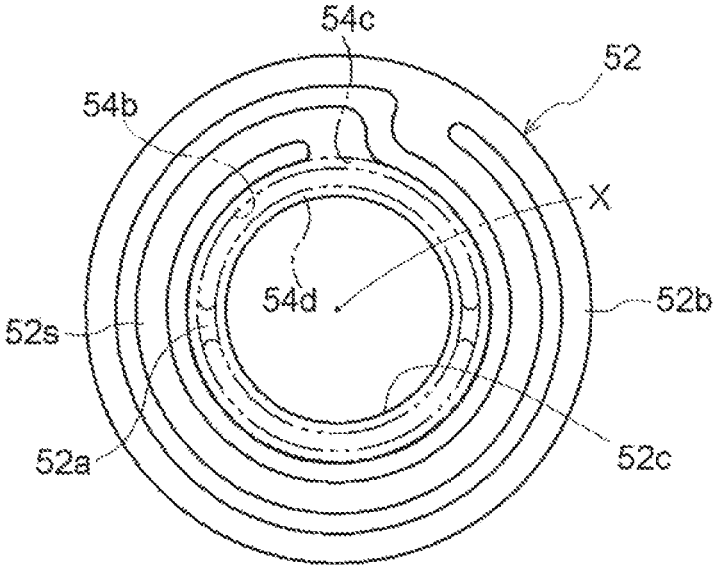
FIG. 7 is a front view of a first valve plate.

As illustrated in FIGS. 5 to 7, the proximal end portion 54S (one example of a valve seat) and the first valve plate 52 (one example of a valve body) that constitute the first check valve CV1 are made of a metal material so as to have the same outer diameter. The first valve plate 52 is arranged at a position that is on the screw portion side of the proximal end portion 54S and that contacts with the proximal end portion 54S. Particularly, a spring plate is used as the first valve plate 52.

In the proximal end portion 54S, there are formed two circulation holes 54*b* (one example of flow passage holes) that are in the annular region around the rotational axis X as a center and that have arc shapes symmetrical to each other with respect to the rotational axis X as a center. This provides a flow passage portion F1 configured by a plurality of the circulation holes 54*b* being annularly arranged in the proximal end portion 54S. Further, on a surface included in the proximal end portion 54S and facing the first valve plate 52, an annular projection 54*c* (one example of an outer circumferential projection or a first projection) whose center is the rotational axis X is formed in an outer region surrounding the circulation holes 54*b*, and an annular projection 54*d* (one example of an inner circumferential projection or a first projection) whose center is the rotational axis X is formed on a radially inner side of the circulation holes 54*b*.

The first valve plate 52 includes an annular closing portion 52*a* that can close the circulation holes 54*b*, an annular holding portion 52*b* that surrounds the closing portion 52*a* and functions as a valve body holding portion holding the closing portion 52*a*, and a spring portion 52*s* provided so as to connect the closing portion 52*a* and the holding portion 52*b* to each other. The spring portion 52*s* allows the closing portion 52*a* to move relative to the holding portion 52*b* in the direction along the rotational axis X. The annular closing portion 52*a* is arranged, around the rotational axis X as a center, at a center position of the first valve plate 52, and the holding portion 52*b* is arranged, around the rotational axis X as a center, on an outer circumferential side in the first valve plate 52. The spring portion 52*s* is formed in a spiral shape so as to connect the closing portion 52*a* and the holding portion 52*b* to each other. The closing portion 52*a* has, on the radially outer side, a diameter larger than that of the annular region of the above-described circulation holes 54*b*, and includes an opening portion 52*c* being formed on the radially inner side and having a diameter smaller than that of the annular region of the circulation holes 54*b*. In this configuration, the opening portion 52*c* is formed in a circular shape whose center is the rotational axis X. Thereby, the first valve plate 52 can close the circulation holes 54*b* when the closing portion 52*a* closely contacts against the projections 54*c* and 54*d*.

As illustrated in FIGS. 3 to 4, the first valve plate 52 is fixed in the inner space 40R with the holding portion 52*b* being sandwiched and held by the outer cylindrical portion 60*a* of the fixing ring 60 and the proximal end portion 54S.

With such a configuration, when the first check valve CV1 is assembled, the fixing ring 60, the first valve plate 52, and the fluid supply pipe 54 are simply fitted in this order into the inner space 40R of the connection bolt 40, and are thereby set in the optimum positional relation thereamong, and therefore an operation such as positioning becomes unnecessary.

The first check valve CV1 is opened when a pressure on the upstream side in the space between the sleeve 53 and the spool 55 is higher than a pressure on the screw portion side that is the downstream side when seen in a direction in which fluid flows in the first check valve CV1. Specifically, as illustrated in FIG. 3, the spring portion 52*s* (refer to FIG. 7) is elastically deformed by a pressure of hydraulic oil, and thereby, the closing portion 52*a* is separated from the circulation holes 54*b*. This causes hydraulic oil in the space between the sleeve 53 and the spool 55 to flow to the fluid supply pipe 54 via the circulation holes 54*b*. The closing portion 52*a* oscillates back and forth in a range up to the wall portion 60*c* of the fixing ring 60 along the rotational axis X, inside the inner cylindrical portion 60*b* of the fixing ring 60.

In the first check valve CV1, as illustrated in FIG. 4, the closing portion 52*a* contacts (closely contacts) against the projections 54*c* and 54*d* and closes the circulation holes 54*b* by elastic restoration force of the spring portion 52*s* and a pressure of hydraulic oil flowing into the fluid supply pipe 54 when a pressure on the screw portion side exceeds a pressure in the space between the sleeve 53 and the spool 55, or when the spool 55 is set to be at a neutral position Pn. As a result, hydraulic oil is prevented from flowing from the screw portion side to the space between the sleeve 53 and the spool 55.

Two circulation holes 54*b* having shapes symmetrical to each other with respect to the rotational axis X as a center are formed in the proximal end portion 54S, and for this reason, a uniform pressure is applied to the closing portion 52*a*, the closing portion 52*a* is securely separated from the projections 54*c* and 54*d*, and the circulation holes 54*b* can be opened. Thus, hydraulic oil that passes through a pair of the circulation holes 54*b* and flows out to the space on the screw portion side of the proximal end portion 54S can be sent (circulated) into the fluid supply pipe 54 via the opening portion 52*c* on the inner circumferential side of the closing portion 52*a*.

With this configuration, the first check valve CV1 can be made small with the spring plate, and can be accommodated in the inner space 40R of the connection bolt 40. Further, for example, as compared with a configuration in which a check valve is provided outside the connection bolt 40, a flow channel configuration can be simplified. Furthermore, the first check valve CV1 is arranged near the flow channels communicating with the advance chamber Ca and the retarded chamber Cb, and thus, a closing operation can be performed with good response.

[Second Check Valve]

Figure 8:
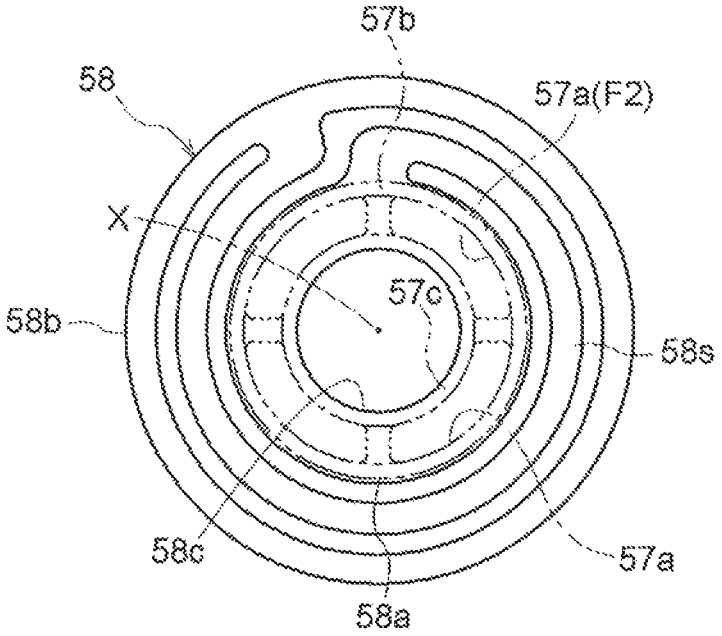
FIG. 8 is a front view of a second valve plate.
Figure 9:
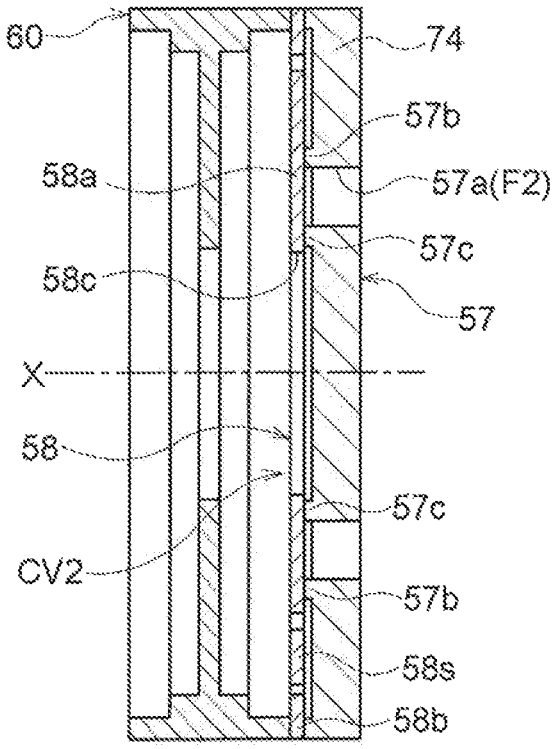
FIG. 9 is a cross-sectional view of a second check valve.

As illustrated in FIGS. 5, 8, and 9, the opening plate 57 (one example of a valve seat) and the second valve plate 58 that constitute the second check valve CV2 are formed so as to have the same outer diameter, the opening plate 57 is arranged on the upstream side in the supply direction of hydraulic oil, and, on the downstream side thereof, the second valve plate 58 is arranged at a position in contact with the opening plate 57. As the second valve plate 58, a spring plate is used.

In the opening plate 57, four flow passage holes 57*a* are formed in an annular region around the rotation axis X as a center so as to have arc shapes symmetrical to each other with respect to the rotational axis X as a center. This provides a flow passage portion F2 configured by a plurality of the flow passage holes 57*a* being annularly arranged in the opening plate 57. Further, on a surface included in the opening plate 57 and facing the second valve plate 58, an annular projection 57*b* (one example of an outer circumferential projection or a first projection) whose center is the rotational axis X is formed in an outer region surrounding the flow passage holes 57*a*, and an annular projection 57*c* (one example of an inner circumferential projection or a first projection) whose center is the rotational axis X is formed on a radially inner side of the flow passage holes 57*a*.

The second valve plate 58 includes an annular closing portion 58*a* that can close the flow passage holes 58*a*, an annular holding portion 58*b* that surrounds the closing portion 58*a* and functions as a valve body holding portion holding the closing portion 58*a*, and a spring portion 58*s* provided so as to connect the closing portion 58*a* and the holding portion 58*b* to each other. The spring portion 58*s* allows the closing portion 58*a* to move relative to the holding portion 58*b* in the direction along the rotational axis X. The annular closing portion 58*a* is arranged, around the rotational axis X as a center, at a center position of the second valve plate 58, and the holding portion 58*b* is arranged, around the rotational axis X as a center, on an outer circumferential side of the second valve plate 58. The spring portion 58*s* is formed in a spiral shape so as to connect the closing portion 58*a* and the holding portion 58*b* to each other. The closing portion 58*a* has, on the radially outer side, a diameter larger than that of the annular region of the above-described flow passage holes 57*a*, and includes an opening portion 58*c* being formed on the radially inner side and having a diameter smaller than that of the annular region of the flow passage holes 57*a*. In this configuration, the opening portion 58*c* is formed in a circular shape whose center is the rotational axis X. Thereby, the closing portion 58*a* can close the flow passage holes 57*a* when closely contacting against the projections 57*b* and 57*c*.

The holding portion 58*b* of the second valve plate 58 is sandwiched and held by the outer cylindrical portion 60*a* of the fixing ring 60 and the opening plate 57.

With such a configuration, when the second check valve CV2 is assembled, the opening plate 57, the second valve plate 58, and the fixing ring 60 are simply fitted in this order into the inner space 40R of the connection bolt 40, and are thereby set in the optimum positional relation thereamong, and therefore an operation such as positioning becomes unnecessary.

In the second check valve CV2, when hydraulic oil is supplied from the oil pressure pump P to an in-shaft space 5R via the supply flow channel 8, the spring portion 58*s* is elastically deformed as illustrated in FIG. 3, and the closing portion 58*a* is thereby separated from the flow passage holes 57*a* and allows the hydraulic oil to flow into the fluid supply pipe 54.

The closing portion 58*a* oscillates back and forth in a range up to the wall portion 60*c* of the fixing ring 60 along the rotational axis X inside the inner cylindrical portion 60*b* of the fixing ring 60.

In the second check valve CV2, when a pressure on the head portion side and on the downstream side of the second check valve CV2 rises, when a discharge pressure of the oil pressure pump P falls, or when the spool 55 is set to be at the neutral position Pn, as illustrated in FIG. 4, the closing portion 58*a* closely contact with the projections 57*b* and 57*c* of the opening plate 57 by elastic force of the spring portion 58*s*, and closes the flow passage holes 57*a*. As a result, a backflow of hydraulic oil from the downstream side to the upstream side is prevented. Further, the closing portion 58*a* contacts with only the projections 57*b* and 57*c* of the opening plate 57 and closes the flow passage holes 57*a*, thus preventing a trouble that the closing portion 58*a* closely contact with the opening plate 57 and results in difficulty of being separated therefrom.

[Filter]

The filter 59 is configured to include a filtering portion 59*b* in which an annular frame 59*a* having an outer diameter equal to those of the opening plate 57 and the second valve plate 58 includes a central portion formed as a mesh member allowing hydraulic oil to flow therethrough.

The filter 59 is sandwiched and held between the restriction wall 44 in the inner space 40R of the connection bolt 40 and the annular support member 59*c*. The support member 59*c* is held by being pressed against the restriction wall 44 by the opening plate 57.

Since the second check valve CV2 is configured as described above, the size can be reduced. Further, as illustrated in FIG. 3, when the second check valve CV2 is in an opened state, hydraulic oil that flows through the four flow passage holes 57*a* formed in the opening plate 57 flows through the opening portion 58*c* on the inner circumferential side of the closing portion 58*a* and through the opening portion 60*d*, and flows into the pipe portion 54T of the fluid supply pipe 54. In this embodiment, hydraulic oil that passes through the flow passage holes 57*a* flows into the pipe portion 54T via the circular opening portion 58*c* and the circular opening portion 60*d* that are coaxial with the rotational axis X, and thus, it is possible to achieve supply of hydraulic oil in a state where pressure loss is suppressed.

Further, since the four flow passage holes 57*a* having shapes symmetrical to each other with respect to the rotational axis X as a center are formed in the opening plate 57, a uniform pressure is applied to the closing portion 58*a*, and thereby, the closing portion 58*a* is securely separated from the projections 57*b* and 57*c* whereby the flow passage holes 57*a* are opened, and hydraulic oil that passes through the four flow passage holes 57*a* can be sent to the opening portion 58*c* of the closing portion 58*a*.

Particularly, since the second check valve CV2 is accommodated in the inner space 40R of the connection bolt 40, the flow channel configuration is simplified as compared with a configuration in which a second check valve is provided outside the connection bolt 40. Further, since the second check valve CV2 is arranged near the flow channels communicating with the advance chamber Ca and the retard chamber Cb, a closing operation can be performed with good response.

[Assembling of Valve Unit, First Check Valve, Second Check Valve, and Filter]

First, as illustrated in FIG. 5, the filter 59 is inserted from the head portion side of the inner space 40R, and is made to contact against the restriction wall 44. Then, the support member 59*c*, the opening plate 57, the second valve plate 58, the fixing ring 60, the first valve plate 52, and the fluid supply pipe 54 are inserted into the inner space 40R in this order, and are made to contact against each other.

Further, the engagement projection 53T of the sleeve 53 is fitted in the drain groove D, the sleeve 53 is inserted into the inner space 40R, and the end portion wall 53W of the sleeve 53 is made to contact against the proximal end portion 54S of the fluid supply pipe 54.

Furthermore, the spool spring 56 and the spool 55 are fitted, in this order, from an outside of the pipe portion 54T of the fluid supply pipe 54, and are inserted into the inner space 40R.

Lastly, the distal end ring 61 is pressed and fitted in the inner space 40R toward the screw portion side. At a time of this pressing and fitting, the spool body 55*a* of the spool 55 is inserted into the opening portion 61*c* of the distal end ring 61, and the small-diameter portion 55*d* of the land portion 55*b* at a position on the head portion side is pressed against the wall portion 61*b* of the distal end ring 61, thus making a state where the distal end portion on the head portion side in the spool body 55*a* protrudes toward the head portion side from the distal end ring 61. Then, the distal end ring 61 is pressed and fitted deep into the inner space 40R, against pressing force of the spool spring 56 that presses, toward the head portion side, the land portion 55*b* at a position on the screw portion side.

When the pressing and fitting of the distal end ring 61 is completed, the spool 55, the spool spring 56, the sleeve 53, the fluid supply pipe 54, the first check valve CV1, the fixing ring 60, the second check valve CV2, and the filter 59 are positioned in the inner space 40R between the distal end ring 61 and the restriction wall 44 from the head portion side toward the screw portion side.

[Control Mode of Hydraulic Oil]

In the valve opening-closing timing control device A, in a state where electric power is not supplied to the solenoid unit 50 of the electromagnetic unit Va, no pushing force is applied to the spool 55 from the plunger 51, and as illustrated in FIG. 3, pressing force of the spool spring 56 causes the spool 55 to be maintained at a position where the small-diameter portion 55*d* of the land portion 55*b* at the outer position contacts against the wall portion 61*b*.

This position of the spool 55 is the advance position Pa, and by a positional relation among a pair of the land portions 55*b*, the advance communication hole 53*a*, and the retard communication hole 53*b*, the intermediate hole portions 55*c* of the spool 55 and the advance communication hole 53*a* communicate with each other, and the retard communication hole 53*b* communicates with the space (inner space 40R) inside the sleeve 53.

Thereby, hydraulic oil supplied from the oil pressure pump P is supplied to the advance chamber Ca from the supply opening 54*a* of the fluid supply pipe 54 via the intermediate hole portions 55*c* of the spool 55, the advance communication hole 53*a*, and the advance port 41*a*.

At this time, the second check valve CV2 receives fluid pressure directed from a side of the opening plate 57 toward the second valve plate 58, and is in a valve-opened state where this fluid pressure causes the closing portion 58*a* of the second valve plate 58 to be separated from the opening plate 57. In the second check valve CV2 in a valve-closed state (refer to FIGS. 8 and 9), the closing portion 58*a* contacts with only the annular projections 57*b* and 57*c* of the opening plate 57, and thus, a contact area between both thereof is small. For this reason, at a time of shifting to the valve-opened state from the valve-closed state where the closing portion 58*a* and the opening plate 57 contact against each other, it becomes difficult that surface tension is applied between both thereof. Thus, the closing portion 58*a* can be easily separated from the projections 57*b* and 57*c* of the opening plate 57 and open the valve. Therefore, the fluid pressure is easily applied to the closing portion 58*a*, and the second check valve CV2 can quickly perform the valve opening operation whereby hydraulic oil can be quickly supplied to the valve opening-closing timing control device A.

At this time, hydraulic oil in the retard chamber Cb is discharged from the retard port 41*b* to the space between the sleeve 53 and the spool 55 via the retard communication hole 53*b*.

A part of hydraulic oil discharged to the space between the sleeve 53 and the spool 55 is circulated to the fluid supply pipe 54 via the first check valve CV1. The circulated hydraulic oil is supplied to the advance chamber Ca together with hydraulic oil supplied from the oil pressure pump P. By this circulation of hydraulic oil, the hydraulic oil is quickly supplied to the advance chamber Ca.

At this time, the first check valve CV1 receives fluid pressure directed from a side of the fluid supply pipe 54 toward the first valve plate 52, and is in a valve-opened state where this fluid pressure causes the closing portion 52*a* of the first valve plate 52 to be separated from the proximal end portion 54S of the fluid supply pipe 54. In the first check valve CV1 in the valve-closed state (refer to FIGS. 6 and 7), the closing portion 52*a* contacts against only the annular projections 54*c* and 54*d* of the proximal end portion 54S, and thus, a contact area between both thereof is small. For this reason, at a time of shifting to the valve-opened state from the valve-closed state where the closing portion 52*a* and the proximal end portion 54S contact against each other, it becomes difficult that surface tension is applied between both thereof. Thus, the closing portion 52*a* can be easily separated from the projections 54*c* and 54*d* of the proximal end portion 54S and open the valve. Therefore, the fluid pressure is easily applied to the closing portion 52*a*, and the first check valve CV1 can quickly perform the valve opening operation whereby hydraulic oil can be quickly circulated to the fluid supply pipe 54.

The remainder of the hydraulic oil discharged to the space between the sleeve 53 and the spool 55 flows to the drain holes 53*c*, and is discharged to an outside from the end portion on the head portion side in the connection bolt 40 via the drain grooves D.

As a result of the supply and discharge and the circulation of the hydraulic oil, a relative rotational phase is quickly displaced in the advance direction Sa. Particularly, when the lock mechanism L is in the lock state, setting the spool 55 to be at the advance position Pa causes a part of the hydraulic oil supplied to the advance chamber Ca to be supplied from the advance flow channel 33 to the lock mechanism L whereby the lock member 25 is released from the lock recess portion 23*a*, thereby achieving lock releasing.

Supplying predetermined electric power to the solenoid unit 50 of the electromagnetic unit Va causes the plunger 51 to be operated so as to protrude whereby against pressing force of the spool spring 56, the spool 55 can be set to be at the neutral position Pn illustrated in FIG. 4.

Setting the spool 55 to be at the neutral position Pn results in a positional relation in which a pair of land portions 55*b* close the advance communication hole 53*a* and the retard communication hole 53*b* of the sleeve 53 whereby hydraulic oil is not supplied to and discharged from the advance chamber Ca and the retard chamber Cb, and a relative rotational phase is maintained.

Supplying, to the solenoid unit 50 of the electromagnetic unit Va, electric power larger than electric power for the setting to the neutral position Pn causes the plunger 51 to be operated so as to further protrude whereby the spool 55 can be set to be at an un-illustrated retard position.

At the retard position, hydraulic oil supplied from the oil pressure pump P is supplied from the supply opening 54*a* of the fluid supply pipe 54 to the retard chamber Cb via the intermediate hole portion 55*c* of the spool 55, the retard communication hole 53*b*, and the retard port 41*b*.

At the same time, hydraulic oil in the advance chamber Ca is discharged from the advance port 41*a* to the space between the outer circumference of the spool body 55*a* and a portion on a side of the intake camshaft 5 in the wall portion 61*b*, via the advance communication hole 53*a*.

A part of the hydraulic oil discharged to a space between the outer circumference of the spool body 55*a* and a portion on the side of the intake camshaft 5 in the wall portion 61*b* flows from the space into a space between the sleeve 53 and the spool 55 via the drain holes 53*d*, the drain grooves D, and the drain holes 53*c*. The hydraulic oil that flows into the space between the sleeve 53 and the spool 55 is circulated to the fluid supply pipe 54 via the first check valve CV1. The circulated hydraulic oil is supplied to the retard chamber Cb together with hydraulic oil supplied from the oil pressure pump P. The hydraulic oil is quickly supplied to the retard chamber Cb by this circulation of the hydraulic oil.

The remainder of the hydraulic oil discharged to the space between the outer circumference of the spool body 55*a* and a portion on the side of the intake camshaft 5 in the wall portion 61*b* is discharged to an outside via the drain holes 53*d* and the drain grooves D. As a result of such supply and discharge and circulation of hydraulic oil, a relative rotational phase is quickly displaced in the retard direction Sb.

[Modified Example 1 of Second Check Valve]

Figure 10:
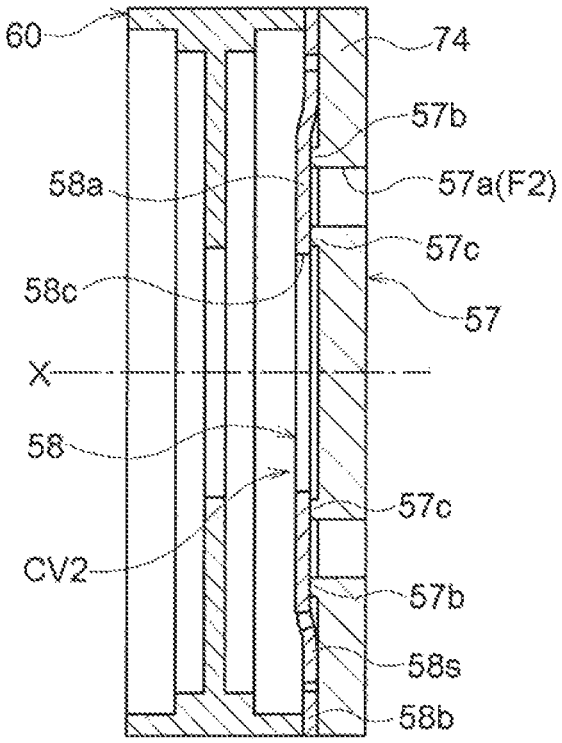
FIG. 10 is a cross-sectional view of a second check valve according to another embodiment.

The following describes a modified example of the second check valve CV2. However, a configuration described below is not limited to the second check valve CV2, and may be adopted as a configuration of the first check valve CV1. As illustrated in FIG. 10, in the second check valve CV2, the holding portion 58*b* of the second valve plate 58 is fixed at a position closer to base portion sides of the first projections 57*b* and 57*c* in the direction along the rotational axis X than a position where the closing portion 58*a* contacts with the projections 57*b* and 57*c* of the opening plate 57.

According to this modified example 1, in the valve-closed state, the spring portion 58*s* connecting the closing portion 58*a* and the holding portion 58*b* to each other is bent from the holding portion 58*b* toward the closing portion 58*a*, and the spring portion 58*s* applies elastic force of pressing the closing portion 58*a* against the opening plate 57 in the direction along the rotational axis X. With such a configuration, at a time of shifting from the valve-opened state to the valve-closed state, application of elastic force of the spring portion 58*s* can quickly cause the closing portion 58*a* to contact against the projections 57*b* and 57*c*, and thereby, time to the valve closure can be shortened.

[Modified Example 2 of Second Check Valve]

Figure 11:
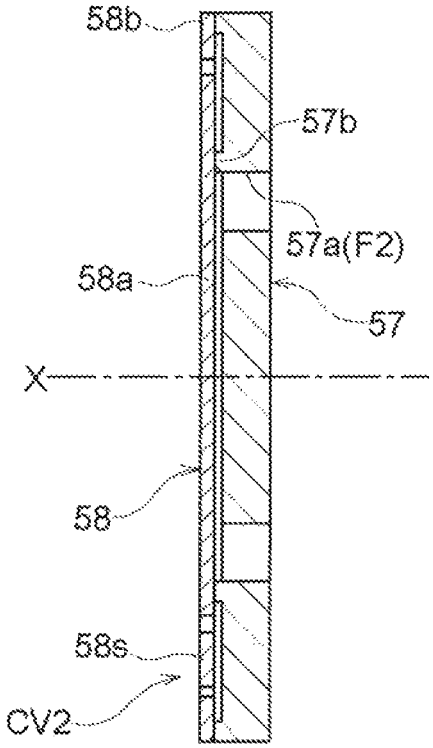
FIG. 11 is a cross-sectional view of a second check valve according to another embodiment.
Figure 12:
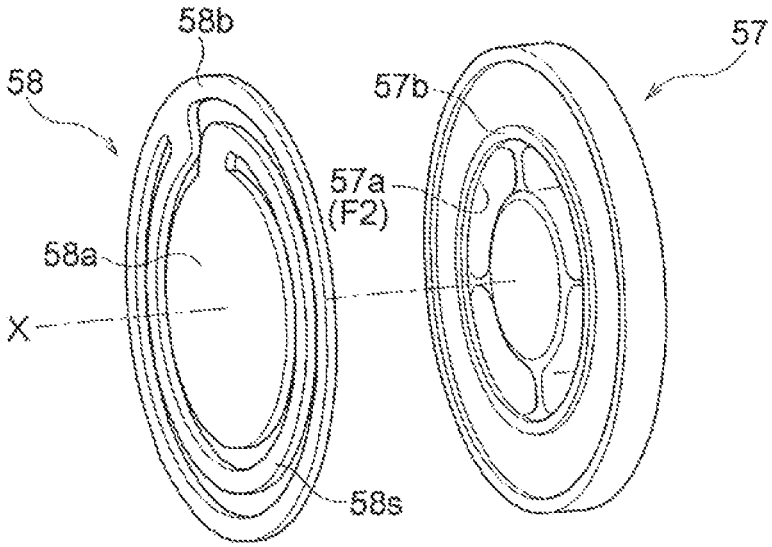
FIG. 12 is an exploded perspective view of a second check valve according to another embodiment.

As illustrated in FIGS. 11 and 12, in the second check valve CV2, the closing portion 58*a* in the second valve plate 58 is formed in a disk shape, and in the opening plate 57, only on the outer circumferential side of the flow passage holes 57*a*, the annular projection 57*b* (one example of an outer circumferential projection) is provided.

[Second Embodiment]

The following describes a second embodiment of a valve opening-closing timing control device A according to this disclosure. The second embodiment differs from the first embodiment in a configuration of the second check valve CV2, and the other constituents thereof are the same as those of the first embodiment. Thus, the following describes only the configuration of the second check valve CV2. However, the configuration described below is not limited to the second check valve CV2, and may be adopted as a configuration of the first check valve CV1.

Figure 13:
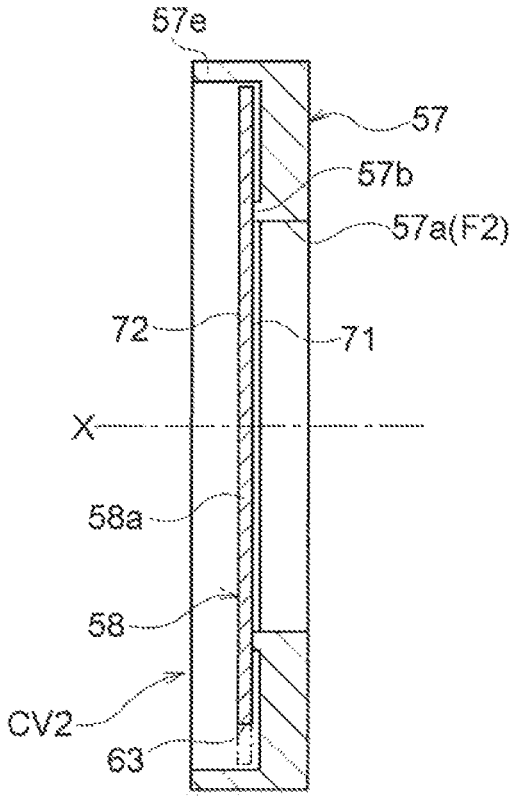
FIG. 13 is a cross-sectional view of a second check valve according to another embodiment.
Figure 14:
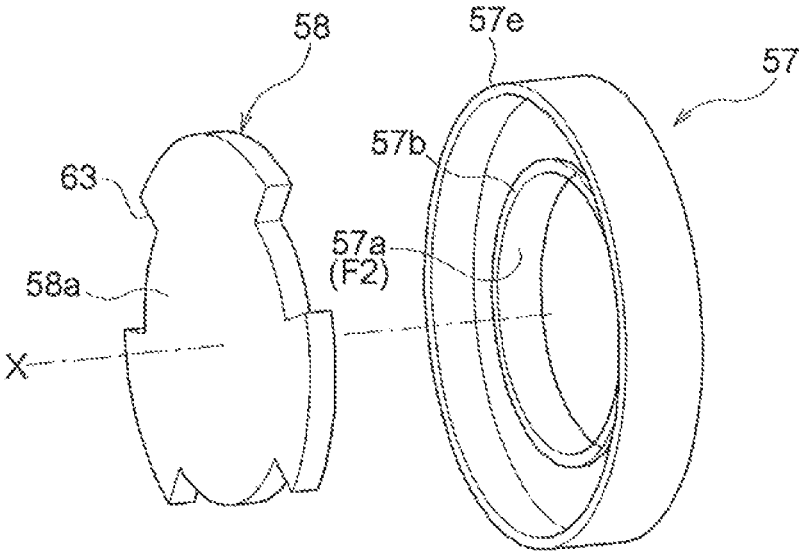
FIG. 14 is an exploded perspective view of a second check valve according to another embodiment.

As illustrated in FIGS. 13 and 14, the second check valve CV2 is configured to include an opening plate 57 and a second valve plate 58. The second valve plate 58 is disk-shaped, and is constituted of only the closing portion 58*a* on the outer circumference of which a plurality of (three in this embodiment) notches 63 are formed. In the opening plate 57, a circular flow passage hole 57*a* is formed at a center thereof so as to penetrate therethrough, and an annular projection 57*e* (one example of a second projection portion) is provided at a position surrounding the second valve plate 58 and a projection 57*b* that surrounds the flow passage hole 57*a*. The entire second valve plate 58 approaches and separates from the opening plate 57, and thereby, the valve is closed and opened. When the second valve plate 58 is opened, hydraulic oil flows into the fluid supply pipe 54 via the flow passage hole 57*a* and the notches 63.

In the second check valve CV2, in a state where the closing portion 58*a* contacts against the projection 57*b* (a first projection portion), the projection 57*e* (the second projection portion) protrudes in the direction along the rotational axis X, further from a surface 72 on a side opposite to a surface 71 contacting against the projection 57*b* (the first projection portion), in the closing portion 58*a*.

With such a configuration, at a time of assembling the second check valve CV2 to the valve unit Vb, the projection 57*e* provided in the opening plate 57 can be used as a positioning portion for the second valve plate 58. Further, the projection 57*e* can guide movement of the second valve plate 58 in the direction along the rotational axis X. As a result, the projection 57*e* can prevent positional deviation of the second valve plate 58 in a direction perpendicular to the direction along the rotational axis X, and thus, the second valve plate 58 is stably operated, and operability of the second valve plate 58 in the second check valve CV2 is improved.

[Modified Example 1 of Second Check Valve of Second Embodiment]

Figure 15:
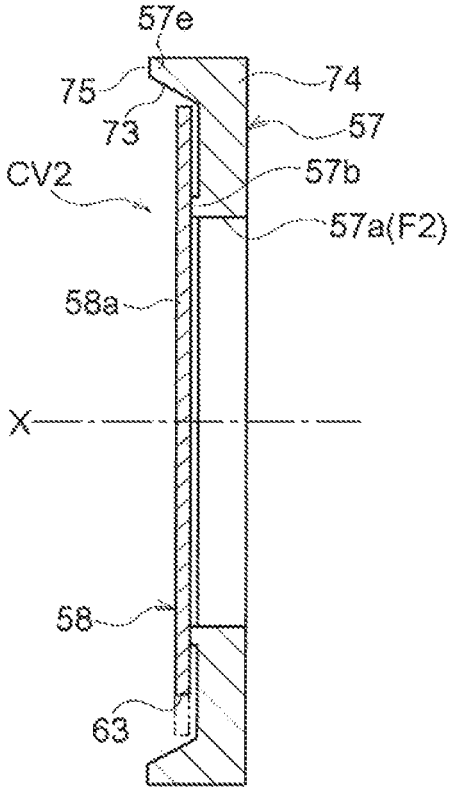
FIG. 15 is a cross-sectional view of a second check valve according to another embodiment.

As illustrated in FIG. 15, in the second check valve CV2, in the direction along the rotational axis X, a surface 73, included in the projection 57*e* (the second projection portion), on a side of facing the projection 57*b* (the first projection portion) has a tapered shape of more separating from the projection 57*b* (the first projection portion) toward a distal end portion 75 from a base portion 74. The second valve plate 58 has the same shape as that in the second embodiment.

As in this configuration, the projection 57*e* has the tapered shape, and thereby, the second valve plate 58 can be easily positioned on the inner side of the projection 57*e* in the opening plate 57, and the second valve plate 58 can be easily assembled to the opening plate 57. Further, at a time of opening the valve, it becomes difficult that the second valve plate 58 contacts with the projection 57*e*, thereby further improving operability of the second valve plate 58 in the second check valve CV2.

[Modified Example 2 of Second Check Valve of Second Embodiment]

Figure 16:
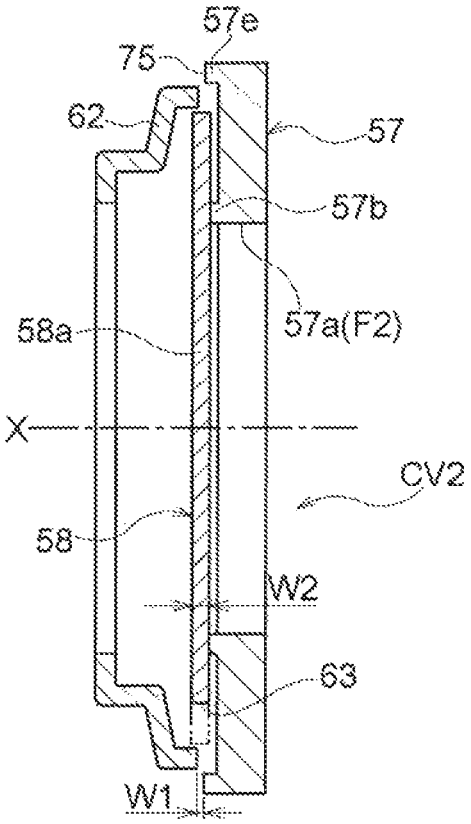
FIG. 16 is a cross-sectional view of a second check valve according to another embodiment.

As illustrated in FIG. 16, the second check valve CV2 includes a guide portion 62 that is at a position facing a distal end portion 75 of the projection 57*e* (the second projection portion) and that guides movement of the second valve plate 58 in the direction along the rotational axis X. The guide portion 62 is provided on the screw portion side of the fixing ring 60. In this modified example, in the second check valve CV2, in the direction along the rotational axis X, a gap W1 between the projection 57*e* (the second projection portion) and the guide portion 62 is equal to or larger than zero, and is smaller than a thickness W2 of the closing portion 58*a*. The second valve plate 58 has the same shape as that in the second embodiment.

As in this configuration, the second valve plate 58 includes the guide portion 62 that is at a position facing the distal end portion 75 of the projection 57*e* and that guides movement of the second valve plate 58 in the direction along the rotational axis X, and thereby, movement of the second valve plate 58 in the direction along the rotational axis X becomes smooth. Further, the gap W1 between the projection 57*e* and the guide portion 62 is equal to or larger than zero and is smaller than the thickness W2 of the closing portion 58*a*, thereby restricting movement of the second valve plate 58 in the direction orthogonal to the rotational axis X, and preventing the second valve plate 58 from being stuck into the gap between the projection 57*e* and the guide portion 62. Therefore, in the second check valve CV2, the second valve plate 58 more stably moves in the direction along the rotational axis X, and response of the valve opening-closing timing control device A is improved.

[Other Embodiments]

Figure 17:
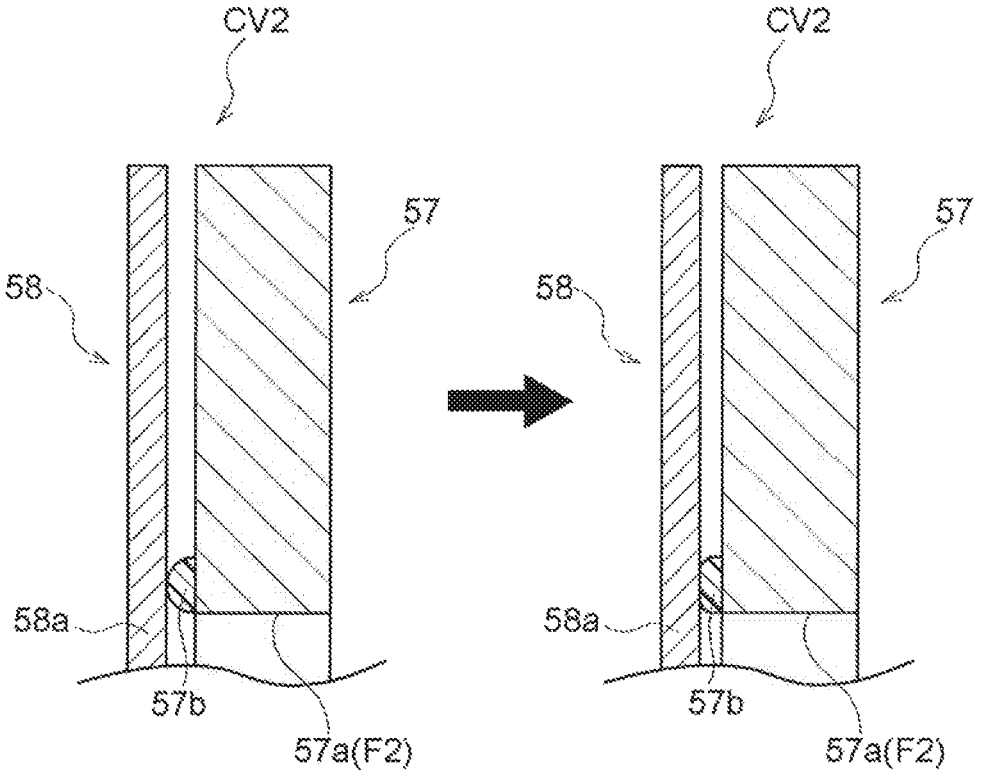
FIG. 17 is a partial enlarged cross-sectional view of a second check valve according to another embodiment.

(1) In the second check valve CV2, at least the projections 57*b* and 57*c* (the first projection portion) in the opening plate 57 (the valve seat) that contact against the second valve plate 58 may be formed of a material having hardness lower than that of the second valve plate 58 (the valve body). In the second check valve CV2 illustrated in FIG. 17, only the projection 57*b* in the opening plate 57 is formed of a material having hardness lower than that of the second valve plate 58 (the valve body). Although not illustrated, the entire opening plate 57 including the projection 57*b* (the first projection portion) may be formed of a material having hardness lower than that of the second valve plate 58 (the valve body). In the first check valve CV1, at least the projections 54*c* and 54*d* (the first projection portion) of the proximal end portion 54S (the valve seat) of the fluid supply pipe 54 that contact with the first valve plate 52 may be formed of a material having hardness lower than that of the first valve plate 52 (the valve body).

Thus, in the second check valve CV2 (or the first check valve CV1), at least the projection 57*b* (the first projection portion) in the opening plate 57 (the valve seat) is formed of a material having hardness lower than that of the second valve plate 58 (the valve body), and for this reason, sealing performance is improved when the closing portion 58*a* of the second valve plate 58 contacts against the projection 57*b*. Further, in the second check valve CV2 (or the first check valve CV1), out of the closing portion 58*a* and the projection 57*b* that contact against and separate from each other, the projection 57*b* having lower hardness is worn, and the closing portion 58*a* having higher hardness is prevented from being worn, and even when the projection 57*b* is worn, the second valve plate 58 is not worn, and thus, sealing performance between the second valve plate 58 and the projection 57*b* is continuously secured, and durability of the second check valve CV2 (or the first check valve CV1) is improved.

(2) As illustrated in FIG. 5, in the above-described embodiments, the description is made above on the configuration in which the valve unit Vb includes the first check valve CV1 and the second check valve CV2. However, the valve unit Vb may be configured so as not to include one of the first check valve CV1 and the second check valve CV2.

(3) In the above-described embodiments, the description is made above on the configuration in which the valve unit Vb includes the first check valve CV1 and the second check valve CV2, and each of the valve seats (the proximal end portion 54S and the opening plate 57) also includes the first projection portion (the projections 54*c*, 54*d*, 57*b*, and 57*c*). However, a configuration may be made in such a way that the valve seat of only one of the first check valve CV1 and the second check valve CV2 includes the first projection portion contacting against the valve body.

(4) In the above-described embodiments, the description is made above on the example in which the circulation holes 54*b* constituting a part of the first check valve CV1 are formed in the proximal end portion 54S as the valve seat of the first check valve CV1, and the flow passage portion F1 is constituted of two circulation holes 54*b* formed in arc shapes symmetrical to each other with respect of the rotational axis X as a center. Further, the description is made above on the example in which the flow passage holes 57*a* constituting a part of the second check valve CV2 are formed in the opening plate 57 as the valve seat of the second check valve CV2, and the flow passage portion F2 is constituted of four circulation holes 57*a* formed in arc shapes symmetrical to each other with respect of the rotational axis X as a center.

However, the numbers of the circulation holes 54*b* and the flow passage holes 57*a* are not limited to two and four, but may be one, three, or equal to or larger than five. Further, the circulation holes 54*b* and the flow passage holes 57*a* are not limited to the slit-shaped penetration holes formed in arc shapes, but may be constituted of a plurality of penetration holes being round holes arranged in an annular shape.

(5) In the above-described embodiments, the description is made on the case as an example in which the drain grooves D are formed, in a posture along the rotational axis X, in a region ranging from the intermediate position and reaching the distal end on the inner circumference in the connection bolt 40, and the distal end ring 61 includes the outer cylindrical portion 61*a* fitted into the inner space 40R. In this case, hydraulic oil discharged from the drain grooves D to an outside is not restricted at all.

However, the distal end ring 61 may be provided with flow rate control members that restrict opening areas (cross sectional areas of the grooves) in the drain grooves D in the direction along the rotational axis X, and a flow passage resistance of hydraulic oil discharged to the outside from the drain grooves D may be adjusted. In some cases, increasing a flow passage resistance of hydraulic oil discharged to the outside from the drain grooves D may increase an amount of hydraulic oil that is included in hydraulic oil to be discharged to the outside via the drain grooves D but is circulated from the first check valve CV1 to the fluid supply pipe 54.

(6) In the above-described embodiments, the description is made above on the case in which the connection bolt 40 as the valve case includes the bolt head portion 42 formed at the outer end portion of the bolt body 41 of an entirely cylindrical shape, and the male screw part 41S is formed on the outer circumference at the end part opposite to the bolt head portion 42 in the bolt body 41.

Then, the description is made above on the case where, in a state where the bolt body 41 of the connection bolt 40 as the valve case is inserted through the annular member 9, the outer rotor 20, and the inner rotor 30, the male screw portion 41S is screwed into the female screw portion 5S of the intake camshaft 5, and the inner rotor 30 (the driven-side rotational body) is fastened to the intake camshaft 5 by a rotational operation of the bolt head portion 42.

However, the valve case does not necessarily need to be the connection bolt 40 with the male screw portion 41S being formed thereon, and the fastening between the inner rotor 30 and the intake camshaft 5 is not limited to the form made by the screwing between the male screw portion 41S of the connection bolt 40 as the valve case and the female screw portion 5S of the intake camshaft 5.

For example, in the valve case, the bolt head portion 42 including a rim portion extending in the radially outward direction may be formed at an outer end portion of the bolt body 41 of an entirely cylindrical shape, and the bolt body 41 of the valve case may be inserted through the annular member 9, the outer rotor 20, and the inner rotor 30.

In this case, for example, penetration holes in the direction along the rotational axis X may be provided in the rim portion of the bolt head portion 42, the annular member 9, and the inner rotor 30, a female screw portion in the direction along the rotational axis X may be further provided at a position that is in the intake camshaft 5 and that is associated with the penetration holes, a fastening bolt (cam bolt) may be inserted through the penetration holes of the rim portion of the bolt head portion 42, the annular member 9, and the inner rotor 30 in this order and screwed into the female screw portion of the intake camshaft 5, and the bolt head portion 42 of the valve case may be pressed to and contacted with the annular member 9 whereby the valve case, the annular member 9, the inner rotor body 31, and the intake camshaft 5 may be integrated with each other, thereby making connection (fastening) between the inner rotor 30 and the intake camshaft 5. In other words, the fastening bolt may connect the inner rotor 30 (the driven-side rotational body) to the intake camshaft 5. The number of the fastening bolts used for the connection may be plural (e.g., three).

Note that the configuration disclosed in the above-described embodiment (including the additional embodiment; the same applies to the following) can be applied in combination with the configuration disclosed in the different embodiment as long as there is no contradiction. The embodiment disclosed in the present description is an example, and the embodiment of this disclosure is not limited to this, and can be appropriately modified within the scope that does not depart from the object of this disclosure. For example, in the above-described embodiment, the configuration including two valves of the first check valve CV1 and the second check valve CV2 is described, but without limitation to this, a configuration including only the first check valve CV1 or a configuration including only the second check valve CV2 may be adopted.

INDUSTRIAL APPLICABILITY

This disclosure can be applied to a valve opening-closing timing control device that includes a drive-side rotational body and a driven-side rotational body, and supplies fluid to a valve unit accommodated in an inner space of the driven-side rotational body.

A valve opening-closing timing control device according to an aspect of this disclosure includes a drive-side rotational body, a driven-side rotational body, an advance chamber, a retard chamber, a valve case, and a valve unit. The drive-side rotational body rotates in synchronization with a crankshaft of an internal combustion engine. The driven-side rotational body is arranged coaxially with a rotational axis of the drive-side rotational body, and rotates integrally with a valve opening-closing camshaft. The advance chamber and the retard chamber are formed between the drive-side rotational body and the driven-side rotational body. In the valve case, an inner space is formed in a direction along the rotational axis so as to range from an outside to the camshaft. The valve unit is accommodated in the inner space so as to be coaxial with the rotation axis, and controls supply and discharge of fluid to and from the advance chamber and the retard chamber. The valve unit includes a check valve on an upstream side to which the fluid is supplied. The check valve includes a valve seat and a valve body. In the valve seat, a flow passage hole through which the fluid flows is formed. The valve body includes a closing portion that can close the flow passage hole. The valve seat includes a first projection portion that is on a side of facing the valve body and that is at a position surrounding the flow passage hole. The check valve is closed by the closing portion contacting against the first projection portion, and is opened by the closing portion being separated from the first projection portion.

In the check valve of the present configuration, the closing portion of the valve body contacts against the first projection portion formed on the valve seat, thereby closing the valve. Thus, the check valve in a valve-closed state is in a state where the valve body contacts against only the first projection portion of the valve seat, and for this reason, an area of an interface where the valve seat and the valve body contact with each other is small. Accordingly, when fluid is applied in a direction in which the valve body separates from the valve seat, the valve body easily separates from the first projection portion of the valve seat, and pressure loss in a fluid supply path can be prevented from occurring.

Therefore, it is possible to configure the valve opening-closing timing control device capable of effectively preventing a backflow of fluid while smoothly supplying fluid to the valve unit via the check valve.

In another configuration, in the valve seat, the first projection portion may include an annular outer circumferential projection formed on an outer side of the flow passage hole.

According to the present configuration, even when a plurality of flow passage holes are provided in the valve seat, the annular outer circumferential projection is formed on the outer side of the flow passage holes, and the outer circumferential projection and the valve body are simply made to contact against each other, thereby enabling the valve to be closed. Accordingly, in the check valve, a configuration of the first projection portion for closing the valve is simplified.

In another configuration, a flow passage portion configured by a plurality of the flow passage holes being arranged annularly may be provided in the valve seat. The first projection portion may further include an annular inner circumferential projection formed on an inner side of the flow passage portion.

In the check valve, in some cases, a penetration hole for allowing fluid to flow therethrough is provided at a center of the valve body. In that case, the valve seat is provided with the flow passage hole on the outer side of the penetration hole, i.e., at a position that does not overlap with the penetration hole of the valve body at a time of closing the valve, and is provided with the outer circumferential projection as the first projection portion on the outer side of the flow passage hole. However, even when the outer circumferential projection of the valve seat and the valve body are in a state of contacting against each other, the flow passage hole of the valve seat and the penetration hole of the valve body are in a state of communicating with each other, and thus, the flow passage hole of the valve seat is not closed by the valve body. Such a phenomenon is remarkable in the case of the flow passage portion as a plurality of the flow passage holes arranged annularly. For this reason, in the present configuration, the valve seat is provided with the flow passage portion configured by a plurality of the flow passage holes being arranged annularly, and the first projection portion further includes the annular inner circumferential projection formed on the inner side of the flow passage portion. Thus, the valve seat includes the annular projections on both the inner side and the outer side of the annular flow passage portion, and the projections contact against the closing portion of the valve body, thereby reliably closing the valve.

In another configuration, the valve body may include a valve body holding portion holding the closing portion. The valve body holding portion may include a holding portion surrounding the closing portion, and a spring portion being provided so as to connect the closing portion and the holding portion and allowing the closing portion to move relative to the holding portion in a direction along the rotational axis. The holding portion may be fixed at a position closer to a base portion side of the first projection portion in a direction along the rotational axis than a position where the closing portion contacts against the first projection portion.

According to the present configuration, in the check valve, in a valve closed state where the closing portion and the first projection portion contact against each other, the holding portion that is included in the valve body holding portion holding the closing portion and that surrounds the closing portion is fixed at a position closer to a base portion side of the first projection portion than the closing portion. At this time, the spring portion connecting the closing portion and the holding portion to each other is in a state of being bent from the holding portion toward the closing portion, and elastic force toward the valve seat is applied to the closing portion from the spring portion in a direction along the rotational axis. With such a configuration, at a time of shifting from the valve opened state to the valve closed state, application of elastic force based on the spring portion can quickly cause the closing portion to contact against the first projection portion whereby time to the valve closure can be shortened.

Further, for example, when the valve body is formed by press working on a plate-shaped workpiece in such a way that the holding portion and the spring portion of the valve body holding portion and the closing portion are formed integrally with each other, the check valve can be configured at low cost.

In another configuration, the valve seat may include a second projection portion formed at a position surrounding the first projection portion and the valve body.

According to the present configuration, the first projection portion of the valve seat and the valve body are surrounded by the second projection portion formed in the valve seat. Thus, by the second projection portion, a position of the valve body that contacts with and separates from the first projection portion of the valve seat can be prevented from being deviated in a direction perpendicular to a direction along the rotational axis. As a result, in the check valve, operability of the valve body is improved. Further, when the valve seat and the valve body are assembled as the check valve to the valve unit, the second projection portion provided in the valve seat can be used as a positioning portion for the valve body.

In another configuration, in a state where the closing portion contacts against the first projection portion, the second projection portion may protrude in a direction along the rotational axis further from a surface being on a side opposite to a surface that is in the closing portion and that contacts against the first projection portion.

With the present configuration, an outer side of the first projection portion of the valve seat and the valve body can be surrounded completely in a direction along the rotational axis by the second projection portion formed in the valve seat. Thereby, movement of the valve body in the direction along the rotational axis can be guided by the second projection portion. As a result, the valve body is operated stably in the direction along the rotational axis, thereby further improving operability of the valve body in the check valve.

In another configuration, in a direction along the rotational axis, a surface, included in the second projection portion, on a side of facing the first projection portion may have a tapered shape of more separating from the first projection portion toward a distal end portion from a base portion.

According to the present configuration, the second projection has the tapered shape of more separating from the first projection portion toward the distal end portion from the base portion, in the surface on the side of facing the first projection portion, and thus, the valve body can be easily positioned on the inner side of the second projection portion in the valve seat. Thereby, the valve body can be easily assembled to the valve seat. Further, at a time of opening the valve, it becomes difficult that the valve body contacts with the second projection portion, thereby further improving operability of the valve body in the check valve.

In another configuration, a guide portion may be further provided at a position facing a distal end portion of the second projection portion. The guide portion may guide movement of the valve body in a direction along the rotational axis. In a direction along the rotational axis, a gap between the second projection portion and the guide portion may be equal to or larger than zero and smaller than a thickness of the closing portion.

According to the present configuration, the guide portion that guides movement of the valve body in a direction along the rotational axis is provided at a position facing the distal end portion of the second projection portion, and thus, the valve body smoothly moves in the direction along the rotational axis. Further, a gap between the second projection portion and the guide portion is equal to or larger than zero and smaller than a thickness of the closing portion, and thereby, movement of the valve body in a direction orthogonal to the rotational axis is restricted, thus preventing the valve body from being stuck into the gap between the second projection portion and the guide portion. Thereby, in the check valve, the valve body moves more stably in the direction along the rotational axis, thus improving response of the valve opening-closing timing control device.

In another configuration, at least the first projection portion in the valve seat may be formed of a material having hardness lower than that of the valve body.

According to the present configuration, at least the first projection portion in the valve seat is formed of a material having hardness lower than that of the valve body, and thus, sealing performance when the valve body contacts against the first projection portion is improved. Further, out of the valve body and the first projection portion that contact against and separate from each other, the first projection portion on the lower-hardness side is worn, and the valve body having higher hardness is prevented from being worn. However, even when the first projection portion is worn, the valve body is not worn, and for this reason, sealing performance between the valve body and the first projection portion is continuously secured, thus improving durability of the check valve.

In another configuration, as the check valve, a first check valve and a second check valve may be each provided, and the first check valve may allow the fluid to be supplied from one of the advance chamber and the retard chamber to the other of the advance chamber and the retard chamber.

In another configuration, as the check valve, a first check valve and a second check valve may be each provided, and the second check valve may allow the fluid to be supplied, from the upstream side to which the fluid is supplied, to the downstream on a side opposite to the upstream side.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve opening-closing timing control device comprising:

a drive-side rotational body rotating in synchronization with a crankshaft of an internal combustion engine;

a driven-side rotational body being arranged coaxially with a rotational axis of the drive-side rotational body and rotating integrally with a valve opening-closing camshaft;

an advance chamber and a retard chamber formed between the drive-side rotational body and the driven-side rotational body;

a valve case in which an inner space is formed in a direction along the rotational axis; and a valve unit being accommodated in the inner space so as to be coaxial with the rotation axis and controlling supply and discharge of fluid to and from the advance chamber and the retard chamber, wherein the valve unit includes a check valve on an upstream side to which the fluid is supplied, the check valve includes a valve seat in which a flow passage hole through which the fluid flows is formed, and a valve body including a closing portion configured to close the flow passage hole, the valve seat includes a first projection portion that faces the valve body and that is at a position surrounding the flow passage hole, the check valve is closed by the closing portion contacting the first projection portion, and is opened by the closing portion being separated from the first projection portion, in the valve seat, the first projection portion includes an annular outer circumferential projection formed on an outer side of the flow passage hole, a flow passage portion configured by a plurality of flow passage holes being arranged annularly is provided in the valve seat, and the first projection portion further includes an annular inner circumferential projection formed on an inner side of the flow passage portion.

2. The valve opening-closing timing control device according to claim 1, wherein the valve body includes a valve body holding portion holding the closing portion, the valve body holding portion includes a holding portion surrounding the closing portion, and a spring portion being provided so as to connect the closing portion and the holding portion and allowing the closing portion to move relative to the holding portion in a direction along the rotational axis, and the holding portion is fixed at a position closer to a base portion side of the first projection portion in the direction along the rotational axis than a position where the closing portion contacts the first projection portion.

3. The valve opening-closing timing control device according to claim 1, wherein at least the first projection portion in the valve seat is formed of a material having hardness lower than that of the valve body.

4. The valve opening-closing timing control device according to claim 1, wherein the check valve comprises a first check valve and a second check valve, and the first check valve allows the fluid to be supplied from one of the advance chamber and the retard chamber to the other of the advance chamber and the retard chamber.

5. The valve opening-closing timing control device according to claim 1, wherein the check valve comprises a first check valve and a second check valve, and the second check valve is configured to supply fluid from the upstream side to a downstream side.

6. A valve opening-closing timing control device comprising:

a drive-side rotational body rotating in synchronization with a crankshaft of an internal combustion engine;

a driven-side rotational body being arranged coaxially with a rotational axis of the drive-side rotational body and rotating integrally with a valve opening-closing camshaft;

an advance chamber and a retard chamber formed between the drive-side rotational body and the driven-side rotational body;

a valve case in which an inner space is formed in a direction along the rotational axis; and a valve unit being accommodated in the inner space so as to be coaxial with the rotation axis and controlling supply and discharge of fluid to and from the advance chamber and the retard chamber, wherein the valve unit includes a check valve on an upstream side to which the fluid is supplied, the check valve includes a valve seat in which a flow passage hole through which the fluid flows is formed, and a valve body including a closing portion configured to close the flow passage hole, the valve seat includes a first projection portion that faces the valve body and that is at a position surrounding the flow passage hole, the check valve is closed by the closing portion contacting the first projection portion, and is opened by the closing portion being separated from the first projection portion, the valve seat includes a second projection portion formed at a position surrounding the first projection portion and the valve body, and in a state where the closing portion contacts the first projection portion, the second projection portion protrudes in a direction along the rotational axis further from a surface being on a side opposite to a surface that is in the closing portion and that contacts the first projection portion.

7. A valve opening-closing timing control device comprising:

a drive-side rotational body rotating in synchronization with a crankshaft of an internal combustion engine;

a driven-side rotational body being arranged coaxially with a rotational axis of the drive-side rotational body and rotating integrally with a valve opening-closing camshaft;

an advance chamber and a retard chamber formed between the drive-side rotational body and the driven-side rotational body;

a valve case in which an inner space is formed in a direction along the rotational axis; and a valve unit being accommodated in the inner space so as to be coaxial with the rotation axis and controlling supply and discharge of fluid to and from the advance chamber and the retard chamber, wherein the valve unit includes a check valve on an upstream side to which the fluid is supplied, the check valve includes a valve seat in which a flow passage hole through which the fluid flows is formed, and a valve body including a closing portion configured to close the flow passage hole, the valve seat includes a first projection portion that faces the valve body and that is at a position surrounding the flow passage hole, the check valve is closed by the closing portion contacting the first projection portion, and is opened by the closing portion being separated from the first projection portion, the valve seat includes a second projection portion formed at a position surrounding the first projection portion and the valve body, and in a direction along the rotational axis, a surface, included in the second projection portion, facing the first projection portion has a tapered shape of tapering away from the first projection portion toward a distal end portion of the surface from a base portion of the surface.

8. A valve opening-closing timing control device comprising:

a drive-side rotational body rotating in synchronization with a crankshaft of an internal combustion engine;

a driven-side rotational body being arranged coaxially with a rotational axis of the drive-side rotational body and rotating integrally with a valve opening-closing camshaft;

an advance chamber and a retard chamber formed between the drive-side rotational body and the driven-side rotational body;

a valve case in which an inner space is formed in a direction along the rotational axis; and a valve unit being accommodated in the inner space so as to be coaxial with the rotation axis and controlling supply and discharge of fluid to and from the advance chamber and the retard chamber, wherein the valve unit includes a check valve on an upstream side to which the fluid is supplied, the check valve includes a valve seat in which a flow passage hole through which the fluid flows is formed, and a valve body including a closing portion configured to close the flow passage hole, the valve seat includes a first projection portion that faces the valve body and that is at a position surrounding the flow passage hole, the check valve is closed by the closing portion contacting the first projection portion, and is opened by the closing portion being separated from the first projection portion, the valve seat includes a second projection portion formed at a position surrounding the first projection portion and the valve body, the valve opening-closing timing control device further comprises a guide portion at a position facing a distal end portion of the second projection portion, the guide portion guiding movement of the valve body in a direction along the rotational axis, and in the direction along the rotational axis, a gap between the second projection portion and the guide portion is equal to or larger than zero and smaller than a thickness of the closing portion.

* * * * *